US009487960B2

(12) United States Patent
Kent et al.

(10) Patent No.: US 9,487,960 B2
(45) Date of Patent: Nov. 8, 2016

(54) SUSPENDED DECK SYSTEMS, KITS, AND METHODS OF INSTALLING, INSPECTING, AND REPAIRING A SUSPENDED DECK SYSTEM

(71) Applicants: Jereme Kent, Findlay, OH (US); John Everett, Ann Arbor, MI (US)

(72) Inventors: Jereme Kent, Findlay, OH (US); John Everett, Ann Arbor, MI (US)

(73) Assignee: ONE ENERGY ENTERPRISES LLC, Findlay, OH (US)

( * ) Notice: Subject to any disclaimer, the term of this patent is extended or adjusted under 35 U.S.C. 154(b) by 0 days.

(21) Appl. No.: 14/718,279

(22) Filed: May 21, 2015

(65) Prior Publication Data

US 2015/0361679 A1 Dec. 17, 2015

Related U.S. Application Data

(60) Provisional application No. 61/998,053, filed on Jun. 17, 2014.

(51) Int. Cl.

| | |
|---|---|
| ***E04H 12/00*** | (2006.01) |
| ***E04G 3/20*** | (2006.01) |
| ***E04H 12/08*** | (2006.01) |
| ***E04H 12/34*** | (2006.01) |

(52) U.S. Cl.

CPC ..... *E04G 3/20* (2013.01); *E04H 12/085* (2013.01); *E04H 12/342* (2013.01)

(58) Field of Classification Search

CPC ..... F03D 11/005; F03D 1/003; F03D 11/04; F05B 2240/912; E04H 12/085; E04H 12/342; E04G 3/20; E04G 3/30

See application file for complete search history.

(56) References Cited

U.S. PATENT DOCUMENTS

| | | | |
|---|---|---|---|
| 629,935 | A | 8/1899 | Sturgis |
| 891,660 | A | 6/1908 | Boeck |
| 2,011,018 | A | 6/1934 | Smith |
| 2,043,128 | A | 6/1934 | Sutton |
| 3,295,266 | A | 1/1967 | Van Bijlevelt |

(Continued)

FOREIGN PATENT DOCUMENTS

| | | |
|---|---|---|
| DE | 102009055726 | 6/2011 |
| DE | 102010008639 | 8/2011 |

(Continued)

OTHER PUBLICATIONS

Telect, Network Store, "Adjustable Bracket for 2" Vertical Trough," Telect.com, pp. 1-3, https://www.telect.com/dnn2/BaseStorePage/tabid/223/ProdID/5837/FZBA15X4.aspx, accessed Nov. 6, 2014.

(Continued)

*Primary Examiner* — Brian Mattei
*Assistant Examiner* — Gisele Ford
(74) *Attorney, Agent, or Firm* — Buchanan Nipper

(57) ABSTRACT

Suspended deck systems, kits, methods of installing a suspended deck system, and methods of inspecting and/or repairing a suspended deck system are described herein. An example embodiment of a suspended deck system comprises a plurality of bosses, a plurality of links, and a deck. Each boss of the plurality of bosses is attached to a tower section between the tower section first flange and the tower section second flange. Each link of the plurality of links has a link first end that is attached to a boss of the plurality of bosses and a link second end. The deck is attached to the link second end of each link of the plurality of links.

20 Claims, 8 Drawing Sheets

(56) References Cited

U.S. PATENT DOCUMENTS

| | | | | |
|---|---|---|---|---|
| 3,768,016 | A | 10/1973 | Townsend et al. | |
| 3,784,025 | A | 1/1974 | Dumit | |
| 4,205,629 | A | 6/1980 | Wix | |
| 4,215,784 | A | 8/1980 | Perkins | |
| 4,253,549 | A | 3/1981 | Petren | |
| 4,348,989 | A | 9/1982 | Vik | |
| 5,067,292 | A | 11/1991 | Finean | |
| 5,287,947 | A | 2/1994 | McSwain | |
| 5,299,655 | A | 4/1994 | Margaritis | |
| 5,695,163 | A | 12/1997 | Tayar | |
| 5,730,248 | A | 3/1998 | Apostolopoulos | |
| 5,783,761 | A * | 7/1998 | Mohino | E02B 9/00 73/865.8 |
| 6,116,179 | A * | 9/2000 | Swinbanks | B23Q 11/0032 104/293 |
| 6,467,233 | B1 | 10/2002 | Maliszewski et al. | |
| 6,585,083 | B2 | 7/2003 | Santarlasci | |
| 6,640,928 | B1 | 11/2003 | Ridley, Jr. | |
| 6,681,897 | B2 | 1/2004 | Gibson et al. | |
| 6,817,444 | B1 | 11/2004 | Shinas | |
| 7,571,882 | B2 | 8/2009 | Walter | |
| 7,735,289 | B2 | 6/2010 | Ollgaard | |
| 7,762,037 | B2 | 7/2010 | Meiners | |
| 8,291,646 | B2 * | 10/2012 | Wobben | F03D 1/001 290/55 |
| 8,584,803 | B2 | 11/2013 | Sani | |
| 8,701,369 | B2 | 4/2014 | Kristensen | |
| 8,827,232 | B2 | 9/2014 | Crowley | |
| 8,870,138 | B2 | 10/2014 | Maguire | |
| 2002/0084142 | A1 | 7/2002 | Brennan et al. | |
| 2003/0147753 | A1 | 8/2003 | Ollgaard | |
| 2004/0020138 | A1 * | 2/2004 | Grearson | E01D 19/106 52/64 |
| 2005/0150721 | A1 | 7/2005 | Fujiwara et al. | |
| 2005/0166521 | A1 * | 8/2005 | Silber | E04H 12/10 52/633 |
| 2005/0247008 | A1 * | 11/2005 | Fujiwara | E04G 1/20 52/651.1 |
| 2006/0131107 | A1 | 6/2006 | Duguay | |
| 2007/0056801 | A1 * | 3/2007 | Iversen | F03D 1/003 182/141 |
| 2007/0125037 | A1 | 6/2007 | Meiners | |
| 2008/0312051 | A1 | 12/2008 | Manyseng | |
| 2009/0031668 | A1 | 2/2009 | Gonzalez | |
| 2009/0126309 | A1 * | 5/2009 | Lyness | E04H 12/00 52/650.3 |
| 2010/0018802 | A1 | 1/2010 | Sani | |
| 2010/0122508 | A1 | 5/2010 | Kristensen | |
| 2010/0127141 | A1 | 5/2010 | Chan et al. | |
| 2010/0314884 | A1 | 12/2010 | Ollgaard et al. | |
| 2011/0140437 | A1 * | 6/2011 | Vemuri | F03D 11/00 290/55 |
| 2011/0214945 | A1 | 9/2011 | Jolicoeur et al. | |
| 2011/0252720 | A1 | 10/2011 | Kristensen | |
| 2011/0254277 | A1 * | 10/2011 | Murata | F03D 11/04 290/55 |
| 2011/0303488 | A1 * | 12/2011 | Besselink | B66F 11/04 182/142 |
| 2012/0174522 | A1 * | 7/2012 | Gregor | E04H 12/06 52/651.01 |
| 2012/0210659 | A1 | 8/2012 | Ollgaard | |
| 2012/0210668 | A1 * | 8/2012 | Kryger | E04H 7/22 52/645 |
| 2012/0241255 | A1 * | 9/2012 | Gomez Santamaria | E06C 7/16 182/113 |
| 2013/0081252 | A1 * | 4/2013 | Markgraf | F03D 11/005 29/432 |
| 2013/0115054 | A1 * | 5/2013 | Yokoyama | F03D 11/04 415/126 |
| 2013/0170929 | A1 * | 7/2013 | Wiechers | F03D 1/003 414/222.01 |
| 2013/0174508 | A1 * | 7/2013 | Reed | E04H 12/08 52/655.1 |
| 2013/0298496 | A1 * | 11/2013 | Uebbing | E04H 12/12 52/745.18 |
| 2013/0299277 | A1 | 11/2013 | Kyatham et al. | |
| 2014/0054110 | A1 * | 2/2014 | Fernandez Gomez | E04G 3/30 182/19 |
| 2014/0075860 | A1 * | 3/2014 | Edenfeld | E04H 12/34 52/173.1 |

FOREIGN PATENT DOCUMENTS

| | | |
|---|---|---|
| DE | 202013005197 | 8/2013 |
| EP | 2187050 | 5/2010 |
| EP | 2574779 | 4/2013 |
| WO | WO2008055576 | 5/2008 |

OTHER PUBLICATIONS

Rack Mount Solutions, Cruxial URack Wall Mount, "URack Series Wall Mount/Under Table Mount," Rackmountsolutions.com, pp. 1-2, http://www.rackmountainsolutions.net/Wallmount_Rack_V_Series.asp, accessed Nov. 6, 2014.

Hysafe Technology, "Uni-8 & Uni-16 Horizontal Lifeline System," Westernsafety.com, pp. 1-15, http://www.westernsafety.com/hysafetechnology/hysafe10pg1.html, accessed Nov. 6, 2014.

Windenergie Fachaufsatz, "Alternative Tumeinbauten entlasten Stahlturme," Erneuerbare Energien Newsletter Pro, May 2011, pp. 9-12.

Tembra GmbH & Co. KG, "Wind Turbine Development," Tembra.com, pp. 1-3, http://www.tembra.com/index.php/tower/html, accessed Nov. 7, 2014.

Tembra GmbH & Co. KG, "Wind Turbine Development," Tembra.com, pp. 1-4, http://www.tembra.com/index.php/tower/html, accessed Nov. 7, 2014.

PES Wind, "Tembra develops weight-reduced tubular steel towers for wind turbines," Windfair.net, pp. 1-4, http://w3.windfair.net/wind-energy/news/15780-tembra-develops-weight-reduced-tubular-steel-towers-for-wind-turbines, accessed Mar. 25, 2015.

* cited by examiner

SUSPENDED DECK SYSTEMS, KITS, AND METHODS OF INSTALLING, INSPECTING, AND REPAIRING A SUSPENDED DECK SYSTEM

RELATED APPLICATION

This application claims the benefit of U.S. Provisional Application No. 61/998,053, filed Jun. 17, 2014. The disclosure of this related application is hereby incorporated into this disclosure in its entirety.

FIELD

The disclosure relates generally to the field of suspended decks.

BACKGROUND

Wind turbines and other tower structures frequently include multiple decks disposed at several levels in an inner chamber of the tower. During construction of the tower, the decks facilitate tower assembly by providing a stable platform when making flange-to-flange connections while connecting adjacent tower sections. The decks are useful after tower construction is complete, too, providing a resting place for weary tower climbers, a staging place for tools and equipment, and a base from which inspections and maintenance activities can be performed.

Conventional tower decks are typically supported from below by steel angles or other components rigidly welded and/or bolted to the tower wall and, for ease of construction, are usually installed while the tower section is in a horizontal position on the ground before it is vertically installed as part of the tower. During construction and the service life of the tower, it periodically becomes necessary to inspect, perform maintenance, and/or make repairs to the decks, the steel angles, or other components attaching the deck to the tower. For example, it is often necessary to inspect and repair the welds between components. Except for structures that are very close to the ladder that extends through the tower, inspection and repair of these components can be extremely difficult due to their position on the underside of the deck.

In addition to decks that are supported from underneath the deck, the art provides examples of decks that are suspended by elongated tensile load carrying members that are each attached at an upper end to the upper flange of the tower section and at a lower end to the lower flange of the tower section. However, these examples present significant drawbacks, such as requiring the manipulation of the upper and lower flanges of the tower section to secure attachment of the load carrying members. In addition, these examples position multiple load carrying members throughout the height of the tower and position a portion of each of the load carrying members below each deck within the tower. This structural arrangement makes inspection and repair of these components extremely difficult and creates a generally crowded environment within the tower, which can make working within the tower more dangerous. Furthermore, long distances separate some of the decks from the point of attachment on the upper flange and/or lower flange, which results in large moment transfers between the tower and the deck after the tower has been assembled.

A need exists, therefore, for improved suspended deck systems, kits, and methods of installing, inspecting, and repairing a suspended deck system.

BRIEF SUMMARY OF SELECTED EXAMPLE EMBODIMENTS

An example embodiment of a suspended deck system for attachment to a tower section comprises a plurality of bosses, a plurality of links, and a deck. The tower section has a tower section lengthwise axis, a tower section first end, a tower section second end, and a tower section body that defines a tower section first flange at the tower section first end, and a tower section second flange at the tower section second end. The plurality of bosses is attached to the tower section body between the tower section first flange and the tower section second flange. Each link of the plurality of links has a link first end, a link second end, and a link length that extends from the link first end to the link second end. The link first end of each link of the plurality of links is attached to a boss of the plurality of bosses. The deck has a deck diameter and is attached to the link second end of each link of the plurality of links. The deck diameter is greater than the link length of each link of the plurality of links.

Another example embodiment of a suspended deck system comprises a tower section, a plurality of bosses, a plurality of links, and a deck. The tower section has a tower section lengthwise axis, a tower section first end, a tower section second end, and a tower section body that defines a tower section first flange at the tower section first end, and a tower section second flange at the tower section second end. The plurality of bosses is attached to the tower section body between the tower section first flange and the tower section second flange. Each link of the plurality of links has a link first end, a link second end, and a link length that extends from the link first end to the link second end. The link first end of each link of the plurality of links is attached to a boss of the plurality of bosses. The deck is attached to the link second end of each link of the plurality of links. The deck has a deck body that has a deck diameter. The deck diameter is greater than the link length of each link of the plurality of links.

Another example embodiment of a suspended deck system comprises a tower that has one or more first tower sections and one or more second tower sections. Each of the one or more first tower sections includes a plurality of bosses, a plurality of links, a deck, and a plurality of fasteners. Each of the one or more first tower sections has a tower section lengthwise axis, a tower section first end, a tower section second end, and a tower section body that defines a tower section first flange at the tower section first end, and a tower section second flange at the tower section second end. Each boss of the plurality of bosses is attached to a tower section body of a tower section of the one or more first tower sections between the tower section first flange and the tower section second flange. Each link of the plurality of links has a link first end, a link second end, and a link length that extends from the link first end to the link second end. The link first end of each link of the plurality of links is attached to a boss of the plurality of bosses. The deck has a deck diameter and is attached to the link second end of each link of the plurality of links. The deck diameter is greater than the link length of each link of the plurality of links. Each of the one or more second tower sections is attached to a tower section of the one or more first tower sections, is free of attachment to the deck, and defines a substantially open tower chamber.

An example embodiment of a kit that includes the components for attaching a suspended deck system to a tower section comprises a plurality of bosses, a plurality of links, a plurality of flanges, a plurality of fasteners, and instructions for use. Each boss of the plurality of bosses is adapted to be attached to the tower section between a first flange and a second flange. Each link of the plurality of links has a link first end that is adapted to be attached to a boss of the plurality of bosses and a link second end that is adapted to be attached to a deck. Each flange of the plurality of flanges is adapted to be attached to a deck. Each fastener of the plurality of fasteners is adapted to be attached to a flange of the plurality of flanges.

Another example embodiment of a kit includes a tower section, a plurality of bosses, a plurality of links, a plurality of flanges, a plurality of fasteners, a deck, and instructions for use. The tower section has a tower section lengthwise axis, a tower section first end, a tower section second end, and a tower section body that defines a tower section first flange at the tower section first end, and a tower section second flange at the tower section second end. Each boss of the plurality of bosses is adapted to be attached to the tower section between a first flange and a second flange. Each link of the plurality of links has a link first end that is adapted to be attached to a boss of the plurality of bosses and a link second end that is adapted to be attached to a deck. Each flange of the plurality of flanges is adapted to be attached to a deck. Each fastener of the plurality of fasteners is adapted to be attached to a flange of the plurality of flanges. The deck is adapted to be attached to the link second end of each link of the plurality of links. The deck has a deck body that has a deck diameter. The deck diameter is greater than the link length of each link of the plurality of links.

Another example embodiment of a kit includes a tower that has one or more first tower sections and one or more second tower sections. Each of the one or more first tower sections includes a plurality of bosses, a plurality of links, a deck, and a plurality of fasteners (e.g., suspended deck system). Each of the one or more first tower sections has a tower section lengthwise axis, a tower section first end, a tower section second end, and a tower section body that defines a tower section first flange at the tower section first end, and a tower section second flange at the tower section second end. Each boss of the plurality of bosses is adapted to be attached to a tower section body of a tower section of the one or more first tower sections between the tower section first flange and the tower section second flange. Each link of the plurality of links has a link first end, a link second end, and a link length that extends from the link first end to the link second end. The link first end of each link of the plurality of links is adapted to be attached to a boss of the plurality of bosses. The deck has a deck diameter and is adapted to be attached to the link second end of each link of the plurality of links. The deck diameter is greater than the link length of each link of the plurality of links. Each of the one or more second tower sections is adapted to be attached to a tower section of the one or more first tower sections, is free of attachment to a suspended deck system, and defines a substantially open tower chamber.

An example method of installing a suspended deck system in a tower section that has a tower section lengthwise axis, a tower section first end, a tower section second end, and a tower section body that defines a tower section inner surface, a tower section outer surface, a tower section first flange at the tower section first end, and a tower section second flange at the tower section second end comprises the following steps: attaching each boss of a plurality of bosses to the tower section inner surface, each boss of the plurality of bosses is attached to the tower section between the tower section first flange and the tower section second flange; attaching a link of a plurality of links to each boss of the plurality of bosses, each link of the plurality of links has a link first end attached to a boss of the plurality of bosses, a link second end, and a link length that extends from the link first end to the link second end; positioning a deck between the tower section first flange and the tower section second flange, the deck has a deck diameter and a plurality of flanges, the deck diameter is greater than the link length of each link of the plurality of links; rotating the deck such that each flange of the plurality of flanges is positioned adjacent a boss of the plurality of bosses; and attaching the link second end of each link of the plurality of links to a flange of the plurality of flanges.

An example method of inspecting and repairing a suspended deck system attached to a tower section comprises the following steps: entering a wind turbine tower that comprises a plurality of tower sections and at least one suspended deck system attached to a tower section, each tower section has a tower section lengthwise axis, a tower section first end, a tower section second end, and a tower section body that defines a tower section chamber, a tower section first flange at the tower section first end, and a tower section second flange at the tower section second end, the at least one suspended deck system comprises a plurality of bosses attached to the tower section body, a plurality of links, and a flange attached to a deck; advancing toward the suspended deck system intended to be inspected and/or repaired, the suspended deck system intended to be inspected/repaired is attached to the tower section between the tower section first flange and the tower section second flange; standing on the deck of the suspended deck system intended to be inspected and/or repaired; inspecting the attachment between each boss of the plurality of bosses and the tower section body, each boss of the plurality of bosses is disposed between the tower section first flange and the deck; inspecting each boss of the plurality of bosses; inspecting each link of the plurality of links, each link of the plurality of links is disposed between the first flange of the tower section and the deck; inspecting the attachment between the flange and the deck, the attachment between the flange and the deck is disposed between the deck and the first flange of the tower section; inspecting the flange; determining whether repair of a component is required; repairing the component; exiting the wind turbine tower.

DETAILED DESCRIPTION

The following detailed description and the appended drawings describe and illustrate various example embodiments of suspended deck systems, kits, methods of installing a suspended deck system, and methods of inspecting and repairing a suspended deck system. The description and illustration of these examples are provided to enable one skilled in the art to make and use a suspended deck system, a kit that includes a suspended deck system, to practice a method of installing a suspended deck system, and to practice a method of inspecting and repairing a suspended deck system. They are not intended to limit the scope of the claims in any manner.

The use of "e.g.," "etc.," "for instance," "in example," and "or," and grammatically related terms, indicates non-exclusive alternatives without limitation, unless otherwise noted. The term "diameter" refers to the length of a straight line passing from side to side through the center of a body, element, or feature, and does not impart any structural configuration on the body, element, or feature. The term "radius" refers to the length of a straight line passing from the center of a body, element, or feature, to a side of the body, element, or feature and does not impart any structural configuration on the body, element, or feature.

Figure 1:
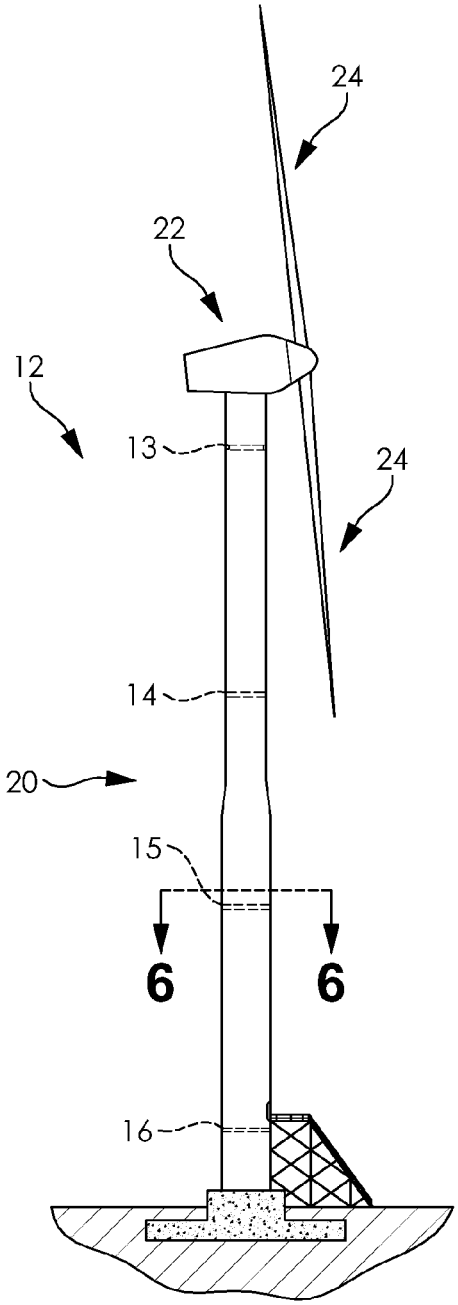
FIG. 1 is an elevation view of a wind turbine that includes an example embodiment of a suspended deck system.
Figure 2:
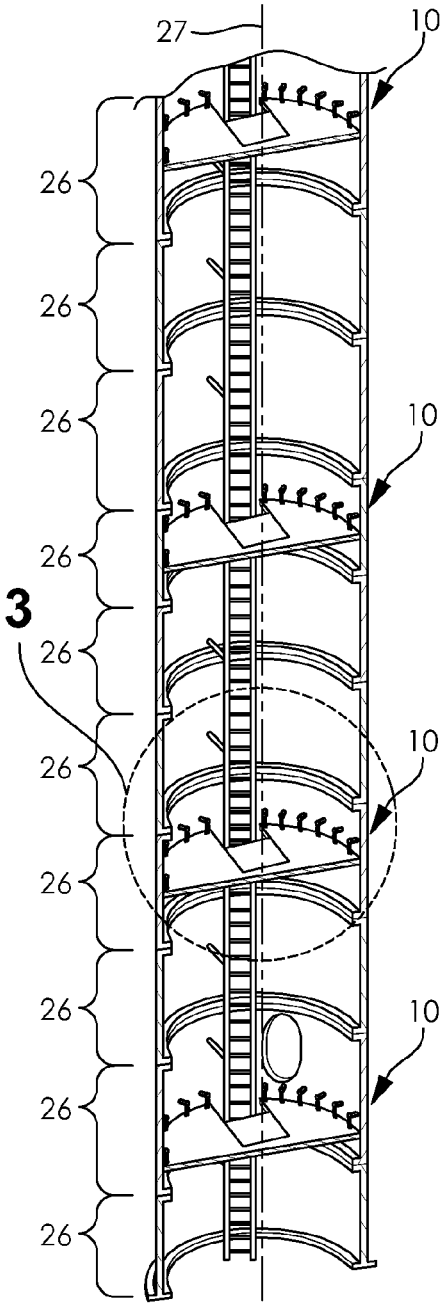
FIG. 2 is a partial sectional view of the tower of the wind turbine illustrated in FIG. 1 taken along the lengthwise axis of the tower.
Figure 3:
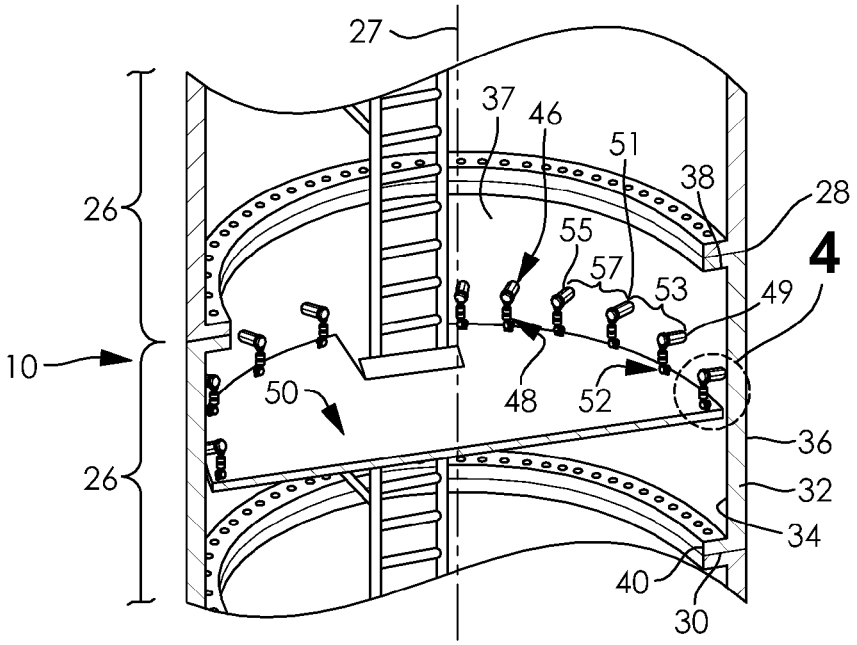
FIG. 3 is a magnified view of area 3 illustrated in FIG. 2.
Figure 4:
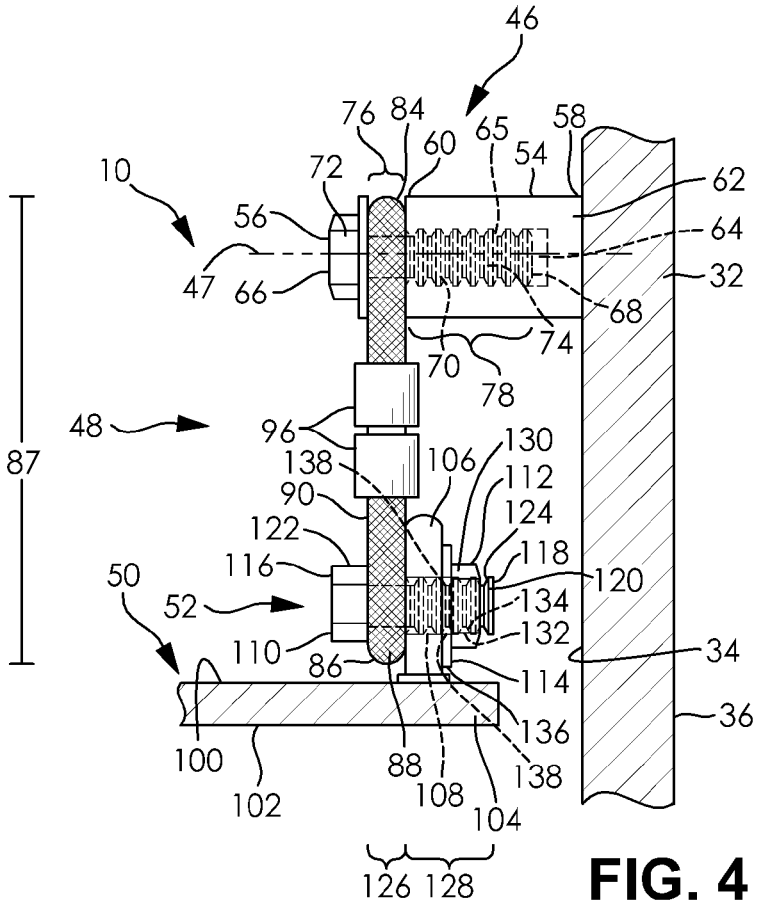
FIG. 4 is a side view of area 4 illustrated in FIG. 3.

FIGS. 1, 2, 3, 4, 5, and 6 illustrate an example embodiment of a suspended deck system 10 attached to a wind turbine 12 at four locations 13, 14, 15, and 16. The wind turbine 12 has a tower 20, a nacelle 22, and rotor blades 24. In the illustrated embodiment, the tower 20 includes multiple tower sections 26 that are each formed as a tubular member. As best illustrated in FIG. 3, each tower section 26 has a tower section lengthwise axis 27, a tower section first end 28, a tower section second end 30, and a tower section body 32 that defines a tower section inner surface 34, a tower section outer surface 36, a tower section chamber 37, a tower section first flange 38 at the tower section first end 28, and a tower section second flange 40 at the tower section second end 30.

In the illustrated embodiment, the suspended deck system 10 comprises a plurality of bosses 46, a plurality of links 48, a deck 50, and a plurality of fasteners 52. Each boss of the plurality of bosses 46 is fixedly attached to the inner surface 34 of the tower section body 32 between the tower section first end 28 and the tower section second end 30. In the illustrated embodiment, each boss of the plurality of bosses 46 is fixedly attached to the inner surface 34 of the tower section body 32 between the tower section first flange 38 and the tower section second flange 40 and is disposed on a plane 47 that passes through, and is disposed orthogonal to, the tower section lengthwise axis 27. Attachment of each boss of a plurality of bosses between a tower section first flange and a tower section second flange avoids the need to manipulate the structure of the tower section first flange and/or the tower section second flange of a tower section to attach a suspended deck system to the tower section.

In the illustrated embodiment, each boss of the plurality of bosses 46 is separated from an adjacent boss of the plurality of bosses 46 by the same distance. A first boss 49 of the plurality of bosses 46 is separated from an adjacent second boss 51 of the plurality of bosses 46 by a first distance 53. A third boss 55 of the plurality of bosses 46 is separated from the adjacent second boss 51 of the plurality of bosses 46 by a second distance 57. In the illustrated embodiment, the first distance 53 is equal to the second distance 57. It is noted, however, that the first and second distances can be different.

Any suitable structure can be used for a boss included in a plurality of bosses. In the illustrated embodiment, each boss of the plurality of bosses 46 comprises a first member 54 and a second member 56 that is releasably attached to the first member 54. The first member 54 has a first end 58, a second end 60, and a body 62 that defines a passageway 64 and internal threads 65. The passageway 64 and internal threads 65 are sized and configured to receive a portion of the shaft 74 of the second member 56, as described herein. The second member 56 has a first end 66, a second end 68, and a body 70 that defines a head 72 and a shaft 74. In the illustrated embodiment, the head 72 is hexagonal and sized and configured to be received by a tool, such as a ratchet or torque wrench and socket, or any other suitable tool, such that the second member 56 can be advanced into and withdrawn from the first member 54. The shaft 74 has a first non-threaded portion 76 and a second threaded portion 78. The second threaded portion 78 is sized and configured to be received by the passageway 64 and threads 65 of the first member 54. It is considered advantageous to include bosses that are sized and configured to minimize the moment at the connection to the tower wall and control the spacing between the edge of the deck and the tower wall. Alternative embodiments can include a bushing or spacer between a first member of a boss and a link and/or between a second member of the boss and the link such that the link can move more freely and minimize moments around the axis of the boss.

In the illustrated embodiment, the first end 58 of the first member 54 of each boss of the plurality of bosses 46 is fixedly attached to the inner surface 34 of the tower section body 32. Attachment between a boss of the plurality of bosses 46 (e.g., first member 54) and the tower section body 32 can be accomplished using any suitable technique or method of attachment and selection of a suitable technique or method of attachment can be based on various considerations, such as the material(s) that forms a boss and/or tower section. Examples of techniques and methods of attachment considered suitable between a boss and a tower section body include welding, fusing, mechanical attachments, threaded attachments, friction fit attachments, snap fit attachments, magnetic attachments, and any other technique or method of attachment considered suitable for a particular embodiment.

While each boss of the plurality of bosses 46 has been illustrated as being fixedly attached to a tower section 26, a boss, or a portion of a boss (e.g., first member), can be releasably attached to a tower section or be formed as an integrated component of a tower section. Selection of a suitable form of attachment between a boss and a tower section body can be based on various considerations, including the material(s) that forms a boss and/or tower section.

While each boss of the plurality of bosses 46 has been illustrated as having a first member 54 that has a particular structural configuration and a second member 56 that has a particular structural configuration, a boss can include any suitable number of members, each having any suitable structural configuration. Selection of a suitable structural configuration for a boss and a suitable number of members for a boss to include can be based on various considerations, such as the structural arrangement of a tower section and/or a link to which the boss is intended to be attached. Examples of structural configurations for a boss considered suitable to include in a suspended deck system include bosses that include a first member that is formed as an integrated component of a tower section, a first member that is a separate component attached to a tower section, a first member that defines a shaft that has a portion sized and configured to be received within a threaded passageway defined by a second member of the boss, a first member that defines a passageway that is sized and configured to receive a portion of a second member of the boss, a first member that defines a passageway that is sized and configured to receive a portion of a link (e.g., portion of a loop, portion of a chain link, projection), a second member that defines threads along the entire length, or a portion of the length, of the shaft of the second member, a second member that has a head that is hexagonal, square, includes a recess sized and configured to receive a tool (e.g., hex key, Allen key), and/or any other structural configuration considered suitable for a particular embodiment. Example numbers of members considered suitable to include in a boss include one, at least one, two, a plurality, three, four, and any other number considered suitable for a particular embodiment.

While each boss of the plurality of bosses 46 has been illustrated as being disposed on a plane 47 that passes through, and is disposed orthogonal to, the tower section lengthwise axis 27, each boss of a plurality of bosses, or one or more bosses of a plurality of bosses, can be disposed on a plane that is positioned at any suitable angle relative a tower section lengthwise axis. Selection of a suitable plane to position each boss of a plurality of bosses, or one or more bosses of a plurality of bosses, can be based on various considerations, such as the structural configuration of a tower section, a deck, and/or the structural configuration of a boss. Example angles considered suitable to position a plane that contains each boss of a plurality of bosses, or one or more bosses of a plurality of bosses, include angles that are orthogonal to a tower section lengthwise axis, angles that are less than 90 degrees relative to a tower section lengthwise axis, angles that are greater than 90 degrees relative to a tower section lengthwise axis, acute angles, obtuse angles, and any other angle considered suitable for a particular embodiment. For example, in alternative embodiments, a first set of a plurality of bosses can be disposed on a first plane and a second set of the plurality of bosses can be disposed on a second plane. Each of the first plane and the second plane passes through, and is disposed at an angle to (e.g., orthogonal), to a tower section lengthwise axis. In some alternative embodiments, the first plane is different than the second plane and is parallel to the second plane.

While each boss of the plurality of bosses 46 has been illustrated as being separated from an adjacent boss of the plurality of bosses 46 by the same distance, any suitable distance can be disposed between adjacent bosses. Selection of a distance to separate adjacent bosses can be based on various considerations, including the structural arrangement of a tower section and/or a deck. For example, a first boss of a plurality of bosses can be separated from a second boss of the plurality of bosses by a first distance and a third boss of the plurality of bosses can be separated from the second boss of the plurality of bosses by a second distance that is less than, equal to, or greater than, the first distance.

While the suspended deck system 10 has been illustrated as having a plurality of bosses 46, a suspended deck system can include any suitable number of bosses and selection of a suitable number of bosses to include in a suspended deck system can be based on various considerations, including the structural arrangement of a tower section. Example numbers of bosses considered suitable to include in a suspended deck system include one, at least one, two, a plurality, three, four, five, six, seven, eight, nine, ten, eleven, twelve, thirteen, fourteen, fifteen, sixteen, seventeen, eighteen, nineteen, more than nineteen, and any other number considered suitable for a particular embodiment. While the deck 50 has been illustrated as defining a notch for a ladder, a deck can alternatively define a passageway for a ladder, or other device, component, or system, such that a portion of the deck extends adjacent to the inner surface (e.g., circumference) of the tower wall and the portion of the deck can be attached to the tower wall using a boss, attachment member, and a flange, as described herein. In these alternative embodiments, the deck has a continuous outer circumference or outer surface that corresponds to the inner circumference or inner surface of the tower wall. Alternatively, a deck can define more than one notch and/or passageway that extends through the deck. Each notch extends from an outer edge of the deck and toward the center of the deck. Each passageway extends from a first opening on the top surface (e.g., first surface) of the deck to a second opening on the bottom surface (e.g., second surface) of the deck. The notches and/or passageways can be sized and configured to allow any suitable device, component, or system to extend through, or pass through, the deck while also achieving a suspended deck system, as described herein. Example devices, components, or systems considered suitable to position within, or pass through, a notch or a passageway include ladders, one or more cables, elevators, and any other device, component, or system considered suitable for a particular embodiment.

A boss included in a suspended deck system can be formed of any suitable material and using any suitable manufacturing technique or method, and selection of a suitable material, technique, and/or method to form a boss according to a particular embodiment can be based on various considerations, including the material(s) that forms the body of a tower section. Examples of materials considered suitable to form a boss include metals, steel, aluminum, rigid materials, non-conductive materials, and any other material considered suitable for a particular embodiment. Examples of techniques and methods of manufacture considered suitable to form a boss include casting, extrusion, and any other technique or method of manufacture considered suitable for a particular embodiment.

While the tower section first flange 38 has been illustrated as disposed at the tower section first end 28 and the tower section second flange 40 has been illustrated as disposed at the tower section second end 30, a tower section first flange can be disposed at any suitable position along the height of the tower section (e.g., between the tower section first end and the tower section second flange) and a tower section second flange can be disposed along at any suitable position along the height of the tower section (e.g., between the tower section first flange and the tower section second end).

In the illustrated embodiment, each link of the plurality of links 48 has a link first end 84, a link second end 86, a link length 87, and a link body 88. The link length 87 extends from the link first end 84 to the link second end 86. The link first end 84 of each link of the plurality of links 48 is movably attached to a boss of the plurality of bosses 46 (e.g., the link can move relative to the boss) and the link second end 86 of each link of the plurality of links 48 is movably attached to the deck 50 (e.g., the link can move relative to the deck (e.g., flange) and/or the attachment member), as described in more detail herein. It is considered advantageous to include a link in a suspended deck system that is long enough to allow the deck to move within a tower such that the link rotates on the axis of a boss and/or an attachment member.

Figure 5:
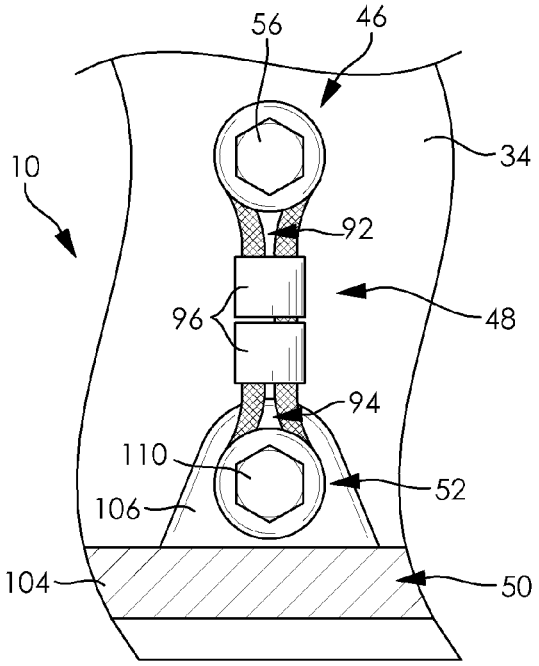
FIG. 5 is a partial sectional view the wind turbine and the suspended deck system illustrated in FIG. 1.
Figure 6:
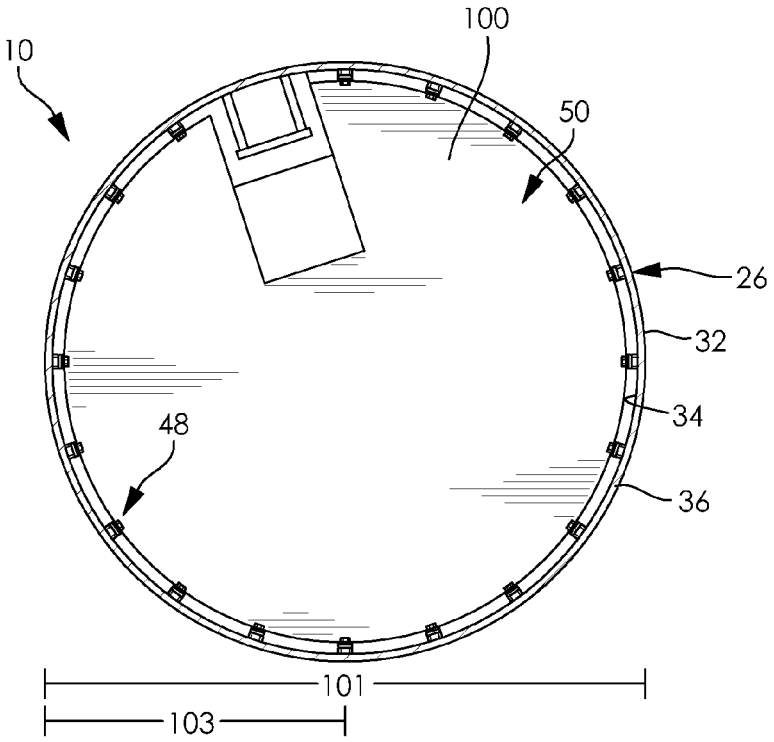
FIG. 6 is a cross-sectional view of the wind turbine illustrated in FIG. 1, taken along line 6-6.

In the illustrated embodiment, each link of the plurality of links 48 comprises a wire member 90 and ferrules 96. As shown in FIG. 5, the link body 88 of each link of the plurality of links 48 defines a first loop 92 and a second loop 94. The first loop 92 is sized and configured to receive a portion of a boss of the plurality of bosses 46. In the illustrated embodiment, the first loop 92 is sized and configured to receive a portion of the shaft 74 of the second member 56 of a boss of the plurality of bosses 46. The second loop 94 is sized and configured to receive a portion of fastener of the plurality of fasteners 52, as described in more detail herein. As best illustrated in FIG. 5, the first loop 92 is formed by attaching a first portion of a link to a second portion of the link using a first ferrule 96 and the second loop 94 is formed by attaching a third portion of the link to a fourth portion of the link using a second ferrule 96.

While each link of the plurality of links 48 has been illustrated as a wire member 90, a link can have any suitable structure and selection of a suitable structure for a link for use in a suspended deck system can be based on various considerations, such as the structural configuration of a boss and/or deck. Examples of structures considered suitable to form a link include wire members, wire members that have a single strand, wire members that have more than one strand, wire members that have a plurality of strands that are disposed parallel to one another along a portion of the link length, wire members that have a plurality of strands that are twisted along a portion of the link length, flexible wire members, rigid members, a solid piece of material (e.g., formed of metal, metal plate) that defines a first passageway that is sized and configured to receive a portion of a boss and a second passageway that is sized and configured to receive a portion of an attachment member, a single chain link, more than one chain link, cables, flexible cables, and any other structure considered suitable for a particular embodiment. A link can have any suitable cross-sectional configuration and any suitable number of strands. Example cross-sectional configurations considered suitable for a link include cross-sectional configurations that are round, substantially round, rectangular, square, oval, and any other configuration considered suitable for a particular embodiment. Example numbers of stands considered suitable to form a link include one, at least one, two, a plurality, three, four, five, six, and any other number considered suitable for a particular embodiment.

While each link of the plurality of links 48 has been illustrated as being movably attached to a boss of the plurality of bosses 46 and as being movably attached to the deck 50, a link can be attached to a boss and/or deck in any suitable manner. Selection of a suitable form of attachment between a link and a boss and/or deck can be based on various considerations, such as the structural arrangement of the link, the boss, and/or deck. For example, each link of a plurality of links, or one or more links of a plurality of links, can be movably attached or fixedly attached to a boss and/or deck. It is considered particularly advantageous, though, to have each link of the plurality of links 48 movably attached to both its boss and the deck at least because this configuration reduces the likelihood of failure of a boss to link or link to deck connection and reduces the cyclic loading and induced moments on each boss during movement of the component to which each boss is attached.

While each link of the plurality of links 48 has been described as having a link first end 84 that is movably attached to a boss of the plurality of bosses 46 and a link second end 86 that is movably attached to the deck 50, any suitable portion of a link can be attached to a boss and/or deck. For example, a first terminal end of a link, or a portion of the link that extends from the first terminal end of the link toward a second terminal end of the link, can be attached to a boss and/or a second terminal end of a link, or a portion of the link that extends from the second terminal end of the link toward a first terminal end of the link, can be attached to a deck (e.g., flange).

While a first ferrule 96 is illustrated as attaching a first portion of a link to a second portion of the link and a second ferrule 96 is illustrated as attaching a third portion of the link to a fourth portion of the link, any suitable structure, technique, and/or method of attachment can be used to attach a first portion of a link to a second portion of a link and/or a third portion of a link to a fourth portion of a link. Examples of structures, techniques, and methods of attachment considered suitable to attach a first portion of a link to a second portion of the link and/or a third portion of a link to a fourth portion of the link include wire clips, welding, fusing, weaving a first portion of a link with a second portion of a link, tying a first portion or a link to a second portion of a link, ferrules, and any other structure or method of attachment considered suitable for a particular embodiment.

While the suspended deck system 10 has been illustrated as having a plurality of links 48, a suspended deck system can include any suitable number of links and selection of a suitable number of links to include in a suspended deck system can be based on various considerations, including the structural arrangement of a tower section. Example numbers of links considered suitable to include in a suspended deck system include one, at least one, two, a plurality, three, four, five, six, seven, eight, nine, ten, eleven, twelve, thirteen, fourteen, fifteen, sixteen, seventeen, eighteen, nineteen, more than nineteen, and any other number considered suitable for a particular embodiment.

A link included in a suspended deck system can be formed of any suitable material and using any suitable manufacturing technique or method, and selection of a suitable material, technique, and/or method to form a link according to a particular embodiment can be based on various considerations, including the material(s) that forms the body of a boss and/or deck. Examples of materials considered suitable to form a link include metals, steel, aluminum, rigid materials, non-conductive materials, and any other material considered suitable for a particular embodiment. Examples of techniques and methods of manufacture considered suitable to form a link include casting, extrusion, and any other technique or method of manufacture considered suitable for a particular embodiment.

In the illustrated embodiment, the deck 50 of the suspended deck system 10 is movably attached to the tower section 26 and has a first surface 100, a second surface 102, a deck diameter 101, a deck radius 103, and a deck body 104 that defines a plurality of flanges 106. The first surface 100 is opposably facing the second surface 102. Each of the deck diameter 101 of the deck 50 and the deck radius 103 of the deck 50 is greater than the link length 87 of each link of the plurality of links 48. The deck 50 is movably attached to the link second end 86 of each link of the plurality of links 48. In the illustrated embodiment, the link second end 86 of each link of the plurality of links 48 is movably attached to a flange of the plurality of flanges 106 using a fastener of the plurality of fasteners 52, as described in more detail herein. The inclusion of a plurality of links 48 such that each link of the plurality of links 48 has a link length 87 that is less than the radius of the deck 50 prevents undesired movement of the deck 50 when installed in a tower section 26 and provides additional stability to the suspended deck system 10.

Each flange of the plurality of flanges 106 extends from the deck 50 and away from the second surface 102 of the deck 50 and defines an aperture 108 that is sized and configured to receive a portion of a fastener of the plurality of fasteners 52. In the illustrated embodiment, each flange of the plurality of flanges 106 is formed as an integrated component of the deck 50 and is disposed near the edge of the deck 102 such that it has a surface that is disposed on a plane that contains the second end 60 of the first member 54 of a boss of the plurality of bosses 46.

Alternative embodiments can include a deck that includes a plurality, or one or more, flanges that are separate components attached to the deck. In these alternative embodiments, attachment between a flange and a deck can be accomplished using any suitable technique or method of attachment and selection of a technique or method of attachment can be based on various considerations, such as the material(s) that forms a deck and/or a flange. Examples of techniques and methods of attachment considered suitable between a flange and the body of a deck include welding, fusing, mechanical attachments, threaded attachments, friction fit attachments, snap fit attachments, magnetic attachments, and any other technique or method of attachment considered suitable for a particular embodiment.

While the first surface 100 has been illustrated as opposably facing the second surface 102, the first surface of a deck can be positioned in any suitable manner relative to a second surface of the deck and determining the orientation of a first surface relative to a second surface can be based on various considerations, including the structural arrangement of a tower section to which a deck is intended to be movably attached. For example, the first surface of a deck can be contained on a first plane that is parallel to a second plane that contains the second surface of the deck or that is disposed at an angle relative to a second plane that contains the second surface of the deck.

While each of the deck diameter 101 of the deck 50 and the deck radius 103 of the deck 50 has been illustrated as greater than the link length 87 of each link of the plurality of links 48, a link can having any suitable link length relative to a deck. Selection of a suitable link length for each link in a plurality of links relative to a deck, or one or more links in a plurality of links relative to a deck, can be based on various considerations, including the structural arrangement of a tower section, boss, and/or a deck. Examples of link lengths considered suitable for a link, each link in a plurality of links, or one or more links in a plurality of links, relative to a deck include lengths that are less than the diameter of a deck, less than the radius of a deck, less than one quarter of the diameter of a deck, less than one eighth of the diameter of a deck, less than one sixth of the radius of a deck, less than one eighth of the radius of a deck, greater than the diameter of a deck, and any other length considered suitable for a particular embodiment.

While the deck 50 has been illustrated as having a deck body 104 that defines a plurality of flanges 106, a deck can define any suitable number of flanges and selection of a suitable number of flanges to include on a deck can be based on various considerations, including the material(s) that form a deck and/or link. Example numbers of flanges considered suitable to include on a deck include one, at least one, two, a plurality, three, four, five, six, seven, eight, nine, ten, eleven, twelve, thirteen, fourteen, fifteen, sixteen, seventeen, eighteen, nineteen, more than nineteen, and any other number considered suitable for a particular embodiment. For example, a deck can define a single flange, or more than one flange, that defines one or more apertures and extends along the entire perimeter, or a portion of the perimeter, of the deck or a single flange, or more than one flange, that defines one or more apertures and extends along the first surface and is offset from the edge of the deck. Alternative embodiments can omit the inclusion of a plurality of flanges and can include a deck that defines a plurality of recesses such that each recess of the plurality of recesses includes structure sized and configured to accomplished attachment between the link second end of a link of a plurality of links and the structure (e.g., a rod attached to the deck within the recess).

While each flange of the plurality of flanges 106 has been illustrated as disposed near the edge of the deck 102 such that it has a surface that is disposed on a plane that contains the second end 60 of the first member 54 of a boss of the plurality of bosses 46, a flange can be positioned at any suitable location on a deck. Selection of a suitable location to position a flange on a deck according to a particular embodiment can be based on various considerations, such as the length of a first member of a boss and/or the thickness of a link. Example locations considered suitable to position a flange on a deck include at, near, or adjacent, the edge of a deck, a distance from the inner wall of a tower section that is equal to, greater than, or less than, the length of the first member of a boss minus the thickness of the flange, and any other location considered suitable for a particular embodiment.

A deck included in a suspended deck system can be formed of any suitable material and using any suitable manufacturing technique or method, and selection of a suitable material, technique, and/or method to form a deck according to a particular embodiment can be based on various considerations, including the material(s) that forms the body of a tower section, boss, and/or link. Examples of materials considered suitable to form a deck include metals, steel, steel alloys, rigid materials, non-conductive materials, and any other material considered suitable for a particular embodiment. Examples of techniques and methods of manufacture considered suitable to form a deck, or one or more components of a deck, include casting, extrusion, and any other technique or method of manufacture considered suitable for a particular embodiment.

Figure 10:
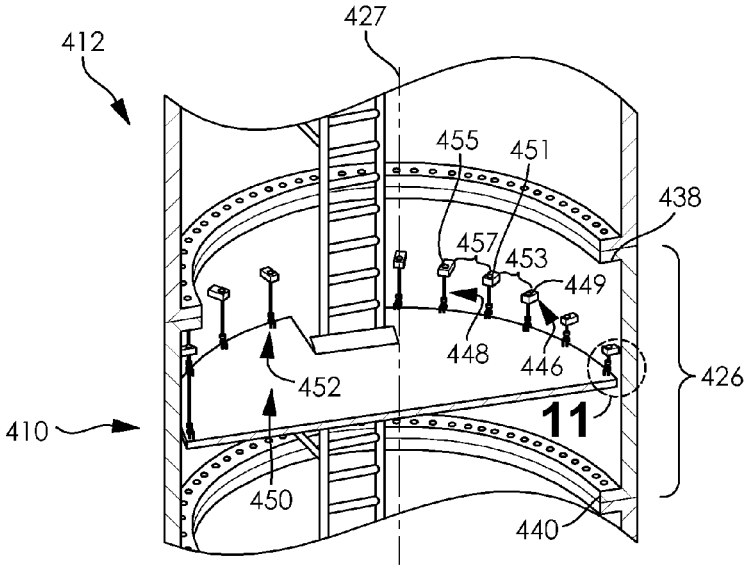
FIG. 10 is a partial sectional view of another wind turbine that includes another example embodiment of a suspended deck system.
Figure 11:
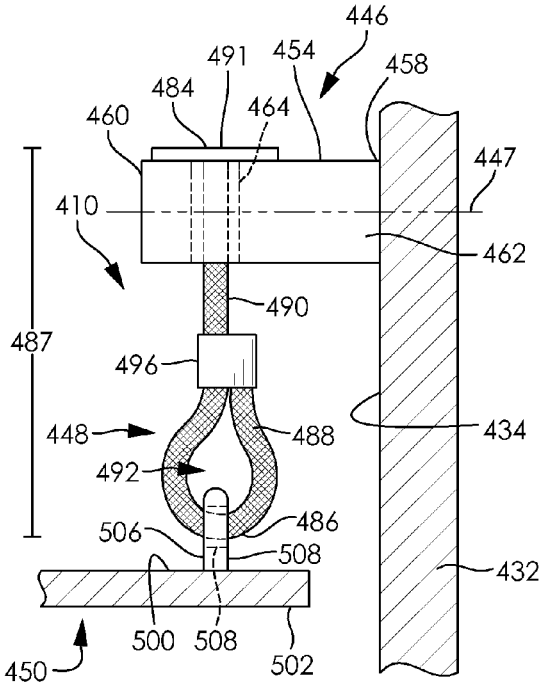
FIG. 11 is a side view of area 11 illustrated in FIG. 10.
Figure 12:
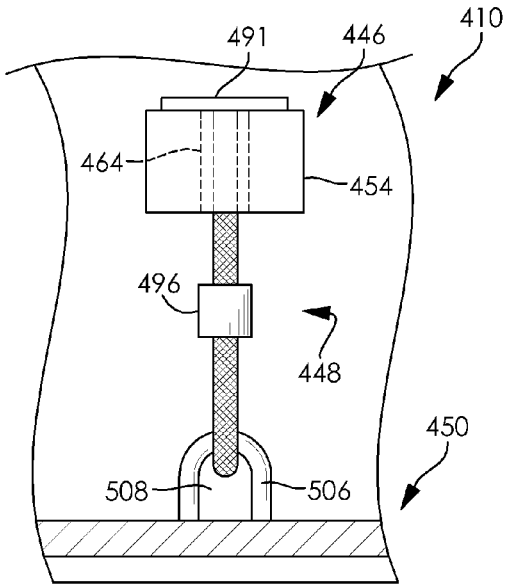
FIG. 12 is a partial sectional view of the wind turbine and suspended deck system illustrated in FIG. 10.

In the illustrated embodiment, each fastener of the plurality of fasteners 52 is adapted to provide releasable attachment between a link of the plurality of links 48 and the deck 50. Any suitable fastener capable of providing releasable attachment between a link and a deck can be included in the suspended deck systems described herein. Examples of fasteners considered suitable to include in a suspended deck system include fasteners that have snap-fit configurations, threaded members, such as bolts, screws, nuts, wingnuts, clamps, washers, and any other fastener considered suitable for a particular embodiment. Alternative embodiments can omit the inclusion of a plurality of fasteners, or one or more fasteners, such that each link, or one or more links, is directly attached to the deck (e.g., a flange). In these embodiments, attachment of a link to a deck can be accomplished using any suitable technique or method of attachment, and the particular technique or method of attachment selected can be based on various considerations, including the material(s) that form the link and/or the deck. For example, a link can be directly attached to a deck by welding the two components to one another, fusing the two components to one another, passing a first portion of the link through an aperture defined by the deck (e.g., on a flange) and attaching the first portion of the link to a second portion of the link, as shown in FIGS. 10, 11, and 12, and any other technique or method of attachment considered suitable for a particular embodiment. Alternative embodiments can include a bushing or spacer between a bolt of an attachment member and a link and/or between a washer of the attachment member and the link such that the link can move more freely relative to the attachment member and/or flange (e.g., minimize moments around the axis of the attachment member and/or flange).

As shown in FIGS. 2, 3, 4, 5, and 6, an example of a suitable fastener for each fastener of the plurality of fasteners 52 comprises a bolt 110, a nut 112, and a washer 114. The bolt 110 has a first end 116, a second end 118, and a body 120 that defines a head 122 and a shaft 124. In the illustrated embodiment, the head 122 is hexagonal and sized and configured to be received by a tool, such as a ratchet or torque wrench and socket, or any other suitable tool, such that the bolt 110 can be advanced into and withdrawn from the nut 112. The shaft 124 has a first non-threaded portion 126 and a second threaded portion 128. The second threaded portion 128 is sized and configured to be received by the threads 134 of the nut 112, as described herein.

The nut 112 has a body 130 that defines a passageway 132 and internal threads 134. The passageway 132 and threads 134 are sized and configured to receive a portion of the shaft 124 of a bolt 110 such that a portion of the second threaded portion 128 of the bolt 110 mates with the threads 134 of the nut 112. The washer 114 has a body 136 that defines a passageway 138 that is sized and configured to receive a portion of a shaft 124 of a bolt 110.

While the bolt 110, nut 112, and washer 114 of a fastener of the plurality of fasteners 52 are illustrated as having a particular structural arrangement, a bolt, nut, and/or washer included in a suspended deck system can have any suitable shape, size, and configuration. The shape, size, and configuration of a fastener included with in a suspended deck system will depend on various considerations, such as the thickness of a link of the plurality of links and/or the thickness of the flange of a deck. Alternative embodiments of a fastener can omit the inclusion of a nut and/or washer. For example, the flange of a deck can define internal threads within an aperture defined on the flange that are sized and configured to receive a portion of a fastener (e.g., bolt) included in a suspended deck system such that the fastener can be releasably attached to the deck. Other alternative embodiments can omit the inclusion of a bolt. For example, the flange of a deck can define a threaded shaft that is sized and configured to be received within a passageway defined by a nut, or other component. Additional alternative embodiments can omit the inclusion of a fastener, or a plurality of fasteners, and a portion of a link, or each link of a plurality of links, can be passed through an aperture defined by a flange and attached to itself or another component (e.g., the flange).

While a plurality of fasteners 52 have been illustrated, a suspended deck system can include any suitable number of fasteners, and selection of a suitable number of fasteners to include in a suspended deck system can be based on various considerations, including the number of bosses included in the suspended deck system and/or the number of flanges included on a deck. Example numbers of fasteners considered suitable to include in a suspended deck system include one, at least one, two, a plurality, three, four, five, six, seven, eight, nine, ten, eleven, twelve, thirteen, fourteen, fifteen, sixteen, seventeen, eighteen, nineteen, more than nineteen, and any other number considered suitable for a particular embodiment.

Each component of a fastener of a plurality of fasteners 52 included in a suspended deck system can be formed of any suitable material and using any suitable manufacturing technique or method, and selection of a suitable material, technique, and/or method to form a fastener can be based on various considerations, including the material(s) that forms a flange included on a deck. Examples of materials considered suitable to form a fastener, or a component of a fastener, include metals, steel, aluminum, steel alloys, rigid materials, non-conductive materials, and any other material considered suitable for a particular embodiment. Examples of techniques and methods of manufacture considered suitable to form a fastener, or a component of a fastener, include casting, extrusion, and any other technique or method of manufacture considered suitable for a particular embodiment.

To assemble the illustrated suspended deck system 10 to the tower section 26, the first member 54 of each boss of the plurality of bosses 46 is fixedly attached to the body 32 of the tower section 26 on a plane 47 that is orthogonal to the tower section lengthwise axis 27. A link of the plurality of links 48 is then movably attached to a boss of the plurality of bosses 46. The second member 56 of each boss of the plurality of bosses 46 is passed through the first loop 92 of a link of the plurality of links 48 such that the second member 56 is partially disposed within the first loop 92. Subsequently, the second member 56 of each boss of the plurality of bosses 46 is releasably attached to the first member 54. In the illustrated embodiment, releasable attachment is accomplished by rotating the second member 56 within the first member 54 such that the second threaded portion 78 defined by the second member 56 mates with the threads 65 defined by the first member 54. This positions the link first end 84 of each link of the plurality of links 48 between the first member 54 and the second member 56 of a boss of the plurality of bosses 46. A link of the plurality of links 48 is then movably attached to the deck 50 (e.g., a flange of the plurality of flanges 106). The bolt 110 of a fastener of the plurality of fasteners 52 is passed through the second loop 94 of a link of the plurality of links 48 such that the bolt 110 is partially disposed within the second loop 94. Subsequently, the bolt 110 is passed through the aperture 108 defined by a flange of the plurality of flanges 106, is passed through the passageway 138 defined by the washer 114 of the fastener of the plurality of fasteners 52, and then is releasably attached to the nut 112 of the fastener of the plurality of fasteners 52. In the illustrated embodiment, releasable attachment is accomplished by rotating the bolt 110 within the nut 112 such that the second threaded portion 128 defined by the bolt 110 mates with the threads 134 defined by the nut 112. This positions the link second end 86 of each link of the plurality of links 48 between the bolt 110 and a flange of the plurality of flanges 106. Alternatively, the link second end of a link of the plurality of links can be disposed between the outside of the flange (e.g., portion directed toward tower wall) and a washer.

While the bolt 110 has been shown as being installed on the inside of a flange of a plurality of flanges 106 and the washer 114 and nut 112 have been shown as being installed on the outside of the flange of the plurality of flanges 106 (between the flange and the tower wall), a bolt, washer, and nut can be installed oppositely. For example, a link of the plurality of links can be movably attached to a deck by passing a bolt of a fastener of the plurality of fasteners through the aperture defined by a flange of the plurality of flanges and then through the second loop of the link of the plurality of links such that the bolt is partially disposed within the second loop. Subsequently, the bolt is passed through the passageway defined by the washer of the fastener of the plurality of fasteners and then is releasably attached to the nut of the fastener of the plurality of fasteners. This positions the washer and nut on the inside of a flange of the plurality of flanges and the bolt on the outside of the flange of the plurality of flanges (e.g., between the flange and the tower wall). Releasable attachment is accomplished by rotating the bolt within the nut such that the second threaded portion defined by the bolt mates with the threads defined by the nut. This positions the link second end of each link of the plurality of links between a flange of the plurality of flanges and a washer. Alternatively, the link second end of a link of the plurality of links can be disposed between the outside of the flange (e.g., portion directed toward tower wall) and a bolt.

Alternative embodiments can include one or more spacers formed of any suitable material (e.g., rubber, polymer, metal) that are disposed between a deck and a tower wall. For example, each spacer can be attached to the deck, free of attachment to the tower wall, and be sized and configured to contact the tower wall or be spaced a predefined distance from the tower wall. Alternatively, each spacer can be attached to the tower wall and be free of attachment to the deck. Each spacer is disposed on a plane that contains the deck and/or each flange attached to the deck and is sized and configured to minimize lateral movement of the deck on a plane that contains the deck but allow rotation of the deck around the lengthwise axis of the tower.

While the link first end 84 of each link of the plurality of links 48 has been illustrated as being disposed between a first member 54 and a second member 56 of a boss of the plurality of bosses 46 and the link second end 86 of each link of the plurality of links 48 has been illustrated as being disposed between a bolt 110 and a flange of the plurality of flanges 106, a link can be attached to a boss and a flange using any suitable structure, technique, or method of attachment. Selection of a suitable structure, technique, or method of attachment to accomplish attachment between a link and a boss or between a link and a flange can be based on various considerations, such as the structural configuration of a link, boss, and/or flange. Example structures, technique, and methods of attachment considered suitable to accomplish attachment between a link and a boss or between a link and a flange include directly attaching a link to a boss, directly attaching a link to a flange, passing a first portion of a link through an aperture defined by a boss or flange and tying the link in a knot or attaching the first portion of the link to a second portion of the link using any suitable technique or method of attachment (e.g., using a ferrule, welding, fusing), attaching a hook to the first end of a link and using the hook to attach the link to a boss, attaching a hook to the second end of a link and using the hook to attach the link a deck (e.g., flange), and/or any other structure, technique, or method of attachment considered suitable for a particular embodiment.

While each suspended deck system 10 has been illustrated as being attached to a tower section 26 that is formed as a tubular member, a suspended deck system can be attached to any suitable structure considered suitable for a particular embodiment. Selection of a suitable structure to attach a suspended deck system can be based on various considerations, including the material(s) that forms the structure and/or the components that form the suspended deck system. Example structures considered suitable to attach a suspended deck system according to an embodiment include tubular members, tower sections, towers, structures that form an enclosed chamber and/or shaft, structures that form a partially enclosed chamber and/or shaft, and any other structure considered suitable for a particular embodiment. For example, the structure to which a suspended deck system is attached can have any cross-sectional configuration, such as square, rectangular, hexagonal, circular, oval, and can include a completely circumferentially closed member, a member that defines an opening along the entirety, or a portion, of its length and/or circumference, a member that defines one or more openings, or a plurality of openings, along its length and/or circumference, and any other structural configuration considered suitable for a particular embodiment.

Figure 7:
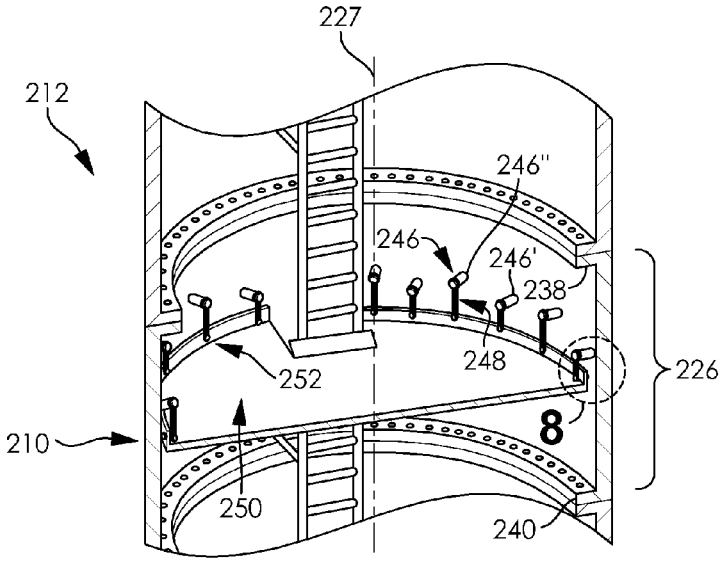
FIG. 7 is a partial sectional view of another wind turbine that includes another example embodiment of a suspended deck system.
Figure 8:
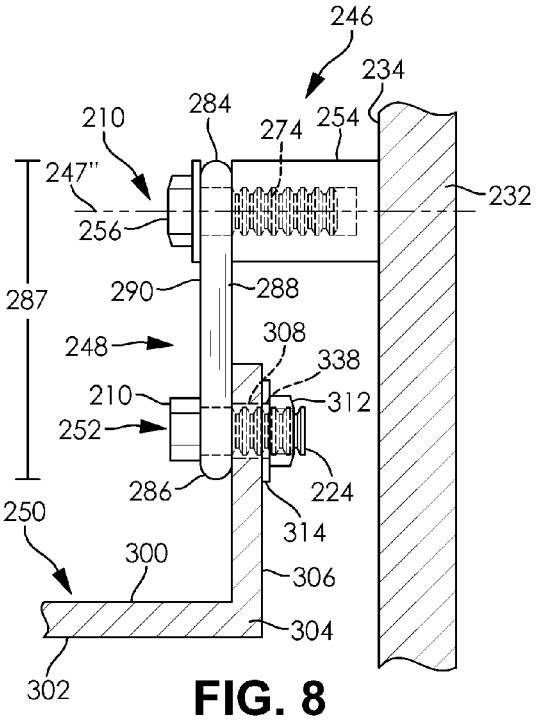
FIG. 8 is a side view of area 8 illustrated in FIG. 7.
Figure 9:
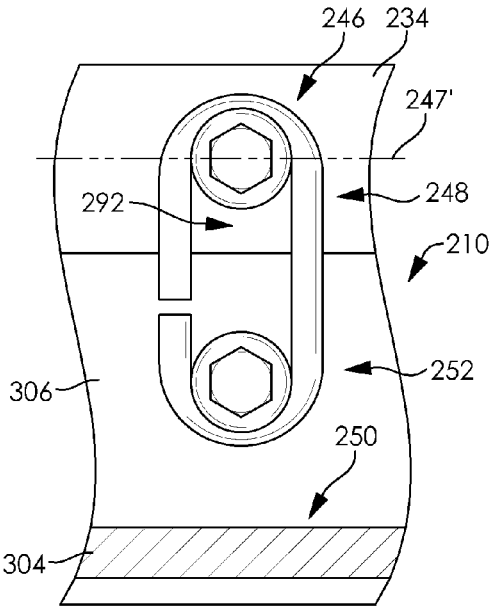
FIG. 9 is a partial sectional view of the wind turbine and suspended deck system illustrated in FIG. 7.

FIGS. 7, 8, and 9 illustrate another example embodiment of a suspended deck system 210 attached to a tower section 226 of a wind turbine 212. The suspended deck system 210 is similar to the suspended deck system 10 illustrated in FIGS. 1, 2, 3, 4, 5, and 6 and described above, except as detailed below. In the illustrated embodiment, the suspended deck system 210 comprises a plurality of bosses 246, a plurality of links 248, a deck 250, and a plurality of fasteners 252.

In the illustrated embodiment, each boss of the plurality of bosses 246 is fixedly attached to the inner surface 234 of the body 232 of the tower section 226 between the tower section first flange 238 and the tower section second flange 240. A first set of bosses 246' of the plurality of bosses 246 is disposed on a first plane 247' that passes through, and is disposed orthogonal to, the tower section lengthwise axis 227 and a second set of bosses of the plurality of bosses 246" is disposed on a second plane 247" that passes through, and is disposed orthogonal to, the tower section lengthwise axis 227. In the illustrated embodiment, the first plane 247' is parallel to the second plane 247" and is different from the second plane 247". Each boss in the first set of bosses 246' is separated from an adjacent boss in the first set of bosses 246' by a first distance. Each boss of in the second set of bosses 246" is separated from an adjacent boss in the second set of bosses 246" by a second distance. The first distance is equal to the second distance.

While a first set of bosses 246' has been illustrated as disposed on a first plane 247' and a second set of bosses 246" has been illustrated as disposed on a second plane 247", any suitable number of bosses can be included on a plane that passes through a tower section lengthwise axis. Example numbers of bosses considered suitable to include on a plane that passes through a tower section lengthwise axis include one, at least one, two, a plurality, three, four, five, six, seven, eight, nine, ten, and any other number considered suitable for a particular embodiment. While each boss in the first set of bosses 246' has been illustrated as being separated from an adjacent boss in the first set of bosses 246' by a first distance and each boss in the second set of bosses 246" has been illustrated as being separated from an adjacent boss in the second set of bosses 246" by a second distance, any suitable distance can be disposed between adjacent bosses. Selection of a distance to separate adjacent bosses can be based on various considerations, including the structural arrangement of a tower section and/or a deck. For example, a first boss in a set of bosses can be separated from a second boss in the set of bosses by a first distance and a third boss in the set of bosses can be separated from the second boss in the set of bosses by a second distance that is less than, equal to, or greater than, the first distance.

While the first plane 247' has been illustrated as being parallel to the second plane 247", a first plane can be disposed at any suitable angle relative to a second plane. For example, alternative to positioning a first plane such that it is parallel to a second plane, a first plane can be disposed at any suitable angle relative to the second plane, such as an acute angle or obtuse angle.

In the illustrated embodiment, each link of the plurality of links 248 has a link first end 284, a link second end 286, a link length 287, and a link body 288. The link length 287 extends from the link first end 284 to the link second end 286. The link first end 284 of each link of the plurality of links 248 is movably attached to a boss of the plurality of bosses 246 and the link second end 286 of each link of the plurality of links 248 is movably attached to the deck 250, as described in more detail herein.

In the illustrated embodiment, each link of the plurality of links 248 comprises a single chain link 290. The link body 288 of each link of the plurality of links 248 defines a partial loop 292. The loop 292 is sized and configured to receive a portion of a boss of the plurality of bosses 246 and a portion of a fastener of the plurality of fasteners 252. In the illustrated embodiment, the loop 292 is sized and configured to receive a portion of the shaft 274 of the second member 256 of a boss of the plurality of bosses 246 and a portion of the shaft 224 of the bolt 210 of a fastener of the plurality of fasteners 252.

While each link of the plurality of links 248 has been illustrated as being movably attached to a boss of the plurality of bosses 246 and as being movably attached to the deck 250, a link can be attached to a boss and/or deck in any suitable manner. Selection of a suitable form of attachment between a link and a boss and/or deck can be based on various considerations, such as the structural arrangement of the link, the boss, and/or deck. For example, each link of a plurality of links, or one or more links of a plurality of links, can be movably attached or fixedly attached to a boss and/or deck.

In the illustrated embodiment, the deck 250 of the suspended deck system 210 is movably attached to the tower section 226 and has a first surface 300, a second surface 302, and a body 304 that defines a flange 306. The first surface 300 is opposably facing the second surface 302. The flange 306 extends from the first surface 300 of the deck 250 and away from the second surface 302 of the deck 250 and defines a plurality of apertures 308. Each aperture of the plurality of apertures 308 is sized and configured to receive a portion of a fastener of the plurality of fasteners 252. In the illustrated embodiment, the flange 306 is formed as an integrated component of the deck 250. The deck 250 is movably attached to the link second end 286 of each link of the plurality of links 248. In the illustrated embodiment, the link second end 286 of each link of the plurality of links 248 is movably attached to the flange 306 using a fastener of the plurality of fasteners 252.

While the flange 306 has been illustrated as being formed as an integrated component of the deck 250, alternative embodiments can include a deck that includes a flange that is a separate component attached to the deck. In these alternative embodiments, attachment between a flange and a deck can be accomplished using any suitable technique or method of attachment and selection of a technique or method of attachment can be based on various considerations, such as the material(s) that forms a deck and/or a flange. Examples of techniques and methods of attachment considered suitable between a flange and the body of a deck include welding, fusing, mechanical attachments, threaded attachments, friction fit attachments, snap fit attachments, magnetic attachments, and any other technique or method of attachment considered suitable for a particular embodiment.

While the flange 306 has been illustrated as extending from the first surface 300 and away from the second surface 302, a flange included on a deck can extend from any suitable portion of a deck and in any suitable direction. Selection of a suitable portion of a deck from which a flange can extend and a suitable direction for a flange to extend can be based on various considerations, including the structural arrangement of the structure to which the deck is intended to be attached. Examples of suitable portions of a deck from which a flange can extend include from the first surface, from the second surface, from an edge of the deck, and/or from any other portion considered suitable for a particular embodiment. Examples of suitable directions in which a flange can extend include away from the first surface, away from the second surface, away from an edge of the deck, and/or in any other direction considered suitable for a particular embodiment.

To assemble the illustrated deck suspension system 210 to a tower section 226, the first member 254 of each boss of the plurality of bosses 246 within the first set of bosses 246' and the second set of bosses 246" is fixedly attached to the body 232 of the tower section 226. A link of the plurality of links 248 is then movably attached to a boss of the plurality of bosses 246. The second member 256 of each boss of the plurality of bosses 246 is passed through the first loop 292 of a link of the plurality of links 248 such that the second member 256 is partially disposed within the first loop 292. Subsequently, the second member 256 of each boss of the plurality of bosses 246 is releasably attached to the first member 254. In the illustrated embodiment, releasable attachment is accomplished by rotating the second member 256 within the first member 254 such that the second threaded portion defined by the second member 256 mates with the threads defined by the first member 254. This positions the link first end 284 of each link of the plurality of links 248 between the first member 254 and the second member 256 of a boss of the plurality of bosses 246. A link of the plurality of links 248 is then movably attached to the deck 250 (e.g., the flange 306). The bolt 310 of a fastener of the plurality of fasteners 252 is passed through the first loop 292 of a link of the plurality of links 248 such that the bolt 310 is partially disposed within the first loop 292. Subsequently, the bolt 310 is passed through an aperture of the plurality of apertures 308 defined by the flange 306, is passed through the passageway defined by the washer 314 of the fastener of the plurality of fasteners 252, and then is releasably attached to the nut 312 of the fastener of the plurality of fasteners 252. In the illustrated embodiment, releasable attachment is accomplished by rotating the bolt 310 within the nut 312 such that the second threaded portion defined by the bolt 310 mates with the threads defined by the nut 312. This positions the link second end 286 of each link of the plurality of links 248 between the bolt 310 and the flange 306. Alternatively, the link second end of a link of the plurality of links can be disposed between the outside of the flange (e.g., portion directed toward tower wall) and a washer.

While the bolt 310 has been shown as being installed on the inside of a flange 306 and the washer 314 and nut 312 have been shown as being installed on the outside of the flange 306 (between the flange and the tower wall), a bolt, washer, and nut can be installed oppositely. For example, a link of the plurality of links can be movably attached to a deck by passing a bolt of a fastener of the plurality of fasteners through an aperture defined by a flange and then through the first loop of the link of the plurality of links such that the bolt is partially disposed within the first loop. Subsequently, the bolt is passed through the passageway defined by the washer of the fastener of the plurality of fasteners and then is releasably attached to the nut of the fastener of the plurality of fasteners. This positions the washer and nut on the inside of a flange and the bolt on the outside of the flange (e.g., between the flange and the tower wall). Releasable attachment is accomplished by rotating the bolt within the nut such that the second threaded portion defined by the bolt mates with the threads defined by the nut. This positions the link second end of each link of the plurality of links between a flange of the plurality of flanges and a washer. Alternatively, the link second end of a link of the plurality of links can be disposed between the outside of the flange (e.g., portion directed toward tower wall) and a bolt.

FIGS. 10, 11, and 12 illustrate another example embodiment of a suspended deck system 410 attached to a tower section 426 of a wind turbine 412. The suspended deck system 410 is similar to the suspended deck system 10 illustrated in FIGS. 1, 2, 3, 4, 5, and 6 and described above, except as detailed below. In the illustrated embodiment, the suspended deck system 410 comprises a plurality of bosses 446, a plurality of links 448, and a deck 450.

In the illustrated embodiment, each boss of the plurality of bosses 446 is fixedly attached to the inner surface 434 of the body 432 of the tower section 426 between the tower section first flange 438 and the tower section second flange 440. Each boss of the plurality of bosses 446 is disposed on a first plane 447 that passes through, and is disposed at an angle to, the lengthwise axis 427 of the tower section 426. In the illustrated embodiment, the first plane 447 is not disposed orthogonal to the tower section lengthwise axis 427. A first boss 449 of the plurality of bosses 446 is separated from an adjacent second boss 451 of the plurality of bosses 446 by a first distance 453. A third boss 455 of the plurality of bosses 446 is separated from the adjacent second boss 451 of the plurality of bosses 446 by a second distance 457. In the illustrated embodiment, the first distance 453 is different than the second distance 457.

Each boss of the plurality of bosses 446 comprises a first member 454 that has a first end 458, a second end 460, and a body 462 that defines a passageway 464. The passageway 464 is sized and configured to receive a portion of a link of the plurality of links 448.

While a first boss 449 of the plurality of bosses 446 has been illustrated as being separated from a second boss 451 of the plurality of bosses 446 by a first distance 453 and a third boss 455 of the plurality of bosses 446 has been illustrated as being separated from the second boss 451 of the plurality of bosses 446 by a second distance 457 that is different than the first distance 453, any suitable distance can be disposed between adjacent bosses. Selection of a distance to separate adjacent bosses can be based on various considerations, including the structural arrangement of a tower section and/or a deck. For example, a first boss of a plurality of bosses can be separated from an adjacent second boss of the plurality of bosses by a first distance and a third boss of the plurality of bosses can be separated from the adjacent second boss of the plurality of bosses by a second distance that is less than, equal to, or greater than, the first distance.

In the illustrated embodiment, each link of the plurality of links 448 has a link first end 484, a link second end 486, a link length 487, and a link body 488. The link length 487 extends from the link first end 484 to the link second end 486. The link first end 484 of each link of the plurality of links 448 is fixedly attached to a boss of the plurality of bosses 446 and the link second end 486 of each link of the plurality of links 448 is movably attached to the deck 450, as described in more detail herein.

In the illustrated embodiment, each link of the plurality of links 448 comprises a wire member 490, a stopper 491, and a ferrule 496. The stopper 491 is attached to the link first end 484 of each link of the plurality of links 484 and is welded to a boss of the plurality of bosses 446. The link body 488 of each link of the plurality of links 448 defines a first loop 492 that is sized and configured to receive a portion of a flange of the plurality of flanges 506 attached to the deck 450. The first loop 492 is formed by attaching a first portion of a link to a second portion of the link using a ferrule 496.

Attachment of a stopper 491 to a link of the plurality of links 484 and attachment of a first portion of a link to a second portion of the link can be accomplished using any suitable technique or method of attachment. Selection of a suitable technique or method of attachment can be based on various considerations, such as the material(s) that forms a stopper and/or link. Examples of techniques and methods of attachment considered suitable between a stopper and a link and/or between a first portion of a link and a second portion of the link include welding, fusing, mechanical attachments, ferrules, threaded attachments, friction fit attachments, snap fit attachments, magnetic attachments, and any other technique or method of attachment considered suitable for a particular embodiment.

While each link of the plurality of links 448 has been illustrated as including a wire member 490, a stopper 491, and a ferrule 496, a link can have any suitable structure and can include any suitable number of components. Selection of a suitable structure for a link for use in a suspended deck system, and a suitable number of components to form a link, can be based on various considerations, such as the structural configuration of a boss and/or deck. For example, alternative embodiments of a link can omit the inclusion of a stopper and, once a portion of the link has been passed through an aperture defined by another component (e.g., boss), the link first end of the link can be enlarged such that it has a diameter that is greater than the diameter of the aperture through which the portion of the link has been passed.

While each link of the plurality of links 448 has been illustrated as being fixedly attached to a boss of the plurality of bosses 446 and as being movably attached to the deck 450, a link can be attached to a boss and/or deck in any suitable manner. Selection of a suitable form of attachment between a link and a boss and/or deck can be based on various considerations, such as the structural arrangement of the link, the boss, and/or deck. For example, each link of a plurality of links, or one or more links of a plurality of links, can be movably attached or fixedly attached to a boss and/or deck.

In the illustrated embodiment, each flange of the plurality of flanges 506 extends from the first surface 500 of the deck 450 and away from the second surface 502 of the deck 450 and defines an aperture 508 that is sized and configured to receive a portion of a link of the plurality of links 448. In the illustrated embodiment, each flange of the plurality of flanges 506 is formed as separate component attached to the deck 450. Attachment between a flange and a deck can be accomplished using any suitable technique or method of attachment and selection of a technique or method of attachment can be based on various considerations, such as the material(s) that forms a deck and/or a flange. Examples of techniques and methods of attachment considered suitable between a flange and the body of a deck include welding, fusing, mechanical attachments, threaded attachments, friction fit attachments, snap fit attachments, magnetic attachments, and any other technique or method of attachment considered suitable for a particular embodiment.

To assemble the illustrated deck suspension system 410 to a tower section 426, the first member 454 of each boss of the plurality of bosses 446 is fixedly attached to the body 432 of the tower section 426 on a plane that is disposed at an angle relative to the tower section lengthwise axis 427. The link second end 486 of a link of the plurality of links 448 is then passed through the passageway 464 defined by a boss of the plurality of bosses 446 until the stopper 491 contacts the boss. Subsequently, the stopper 491 is welded to the boss of the plurality of bosses 446. This positions a first portion of each link of the plurality of links 448 between the first end 458 and the second end 460 of a boss of the plurality of bosses 446. A link of the plurality of links 448 is then movably attached to the deck 450 (e.g., a flange of the plurality of flanges 506). This is accomplished by passing a second portion of the link of the plurality of links 448 through the aperture 508 defined by a flange of the plurality of flanges 506 and attaching the second portion of the link to a third portion of the link using a ferrule 496. This positions the link second end 486 of each link of the plurality of links 448 between a flange of the plurality of flanges 506 and the deck 450 and between a flange of the plurality of flanges 506 and the inner surface 434 of the tower section 426.

While a portion of a link of each link of the plurality of links 448 has been illustrated as being passed through an aperture 508 of a flange of the plurality of flanges 506, a link can be attached to a flange using any suitable structure, technique, or method of attachment. Selection of a suitable structure, technique, or method of attachment to accomplish attachment between a link and a flange can be based on various considerations, such as the structural configuration of a link and/or flange. Example structures, techniques, and method of attachment considered suitable to accomplish attachment between a link and a deck include directly attaching the link to a flange, as described herein, attaching an attachment member (e.g., screw, bolt) to the flange such that the link second end of a link is disposed between the attachment member and the flange, and any other structure or attachment mechanism considered suitable for a particular embodiment.

While the bosses, links, decks, and fasteners illustrated herein have been illustrated as having particular structural arrangements, these structural arrangements are merely examples of those considered suitable for use in a suspended deck system. A boss, link, deck, and fastener included in a suspended deck system can have any suitable structural arrangement and selection of a suitable structural arrangement for a boss, link, deck, and/or fastener can be based on various considerations, including the structural arrangement of the component to which the suspended deck system is intended to be attached.

While particular structures, techniques, and methods of attachment between a link and a boss and between a link and a deck have been illustrated, these structures, techniques, and methods of attachment are merely examples of suitable structures, techniques, and methods of attachment that can be used in a suspended deck system. Any suitable structure, technique, or method of attachment between a link and a boss and between a link and a deck can be used. For example, the structures, techniques, and methods of attachment described herein between a link and a boss can alternatively be used between a link and a deck and the structures, techniques, and methods of attachment described herein between a link and a deck can alternatively be used between a link and a boss.

Figure 13:
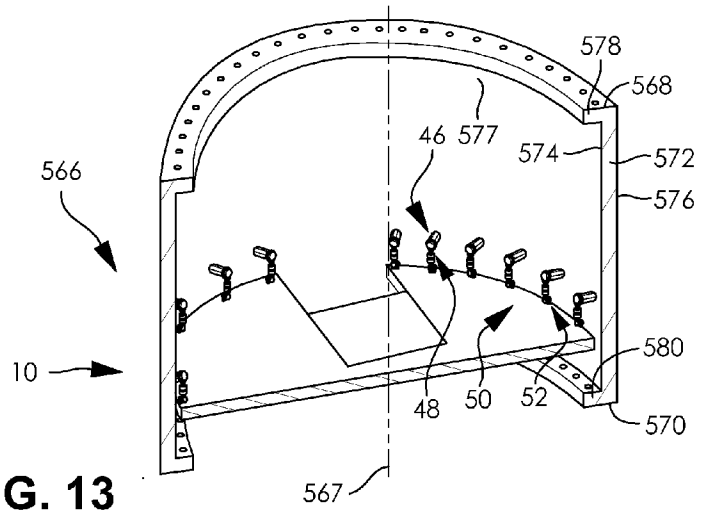
FIG. 13 is a partial sectional view of an example embodiment of a tower section that includes a suspended deck system.

While the various embodiments of the suspended deck systems illustrated herein have been illustrated as being attached to a tower section that is a part of the tower of a wind turbine (e.g., wind turbine 12), a suspended deck system can include a tower and/or a tower section. A tower section that includes a suspended deck system, such as those described herein, can be a part of any suitable tower, provided as its own assembled structure, and/or as a kit. For example, FIG. 13 illustrates an example embodiment of a suspended deck system that includes a tower section 566, according to an embodiment, and the components of the suspended deck system 10. Thus, the suspended deck system illustrated in FIG. 13 comprises a tower section 566, a plurality of bosses 46, a plurality of links 48, a deck 50, and a plurality of fasteners 52. In the illustrated embodiment, the tower section 566 is similar to the tower section 26 illustrated in FIGS. 1, 2, 3, 4, 5, and 6 and described above, except as detailed below. In the illustrated embodiment, the tower section 566 has a tower section lengthwise axis 567, a tower section first end 568, a tower section second end 570, and a tower section body 572 that defines an inner surface 574, an outer surface 576, a tower section chamber 577, a tower section first flange 578 at the tower section first end 568, and a tower section second flange 580 at the tower section second end 580. In the illustrated embodiment, each of the tower section first end 568 and the tower section second end 570 is a terminal end of the tower section 566. The components on the suspended deck system 10 are attached to the tower section 566.

While the tower section 566 has been illustrated as having a particular structural arrangement, a tower section provided as an assembled structure and/or included in a suspended deck system can have any suitable structural arrangement. Selection of a suitable structural arrangement for a tower section according to a particular embodiment can be based on various considerations, including the intended use of the tower section and/or the suspended deck system. Example structures considered suitable to attach a suspended deck system according to an embodiment, or to include in a suspended deck system, include tubular members, tower sections, towers, structures that form an enclosed chamber and/or shaft, structures that form a partially enclosed chamber and/or shaft, and any other structure considered suitable for a particular embodiment.

While the components of the suspended deck system 10 have been illustrated as attached to tower section 566, any suitable suspended deck system, or component of a suspended deck system, can be attached to a tower section, or other suitable structure. Selection of a suitable suspended deck system to attach to a structure according to a particular embodiment can be based on various considerations, such as the intended use of the structure. Example suspended deck systems considered suitable to attach to a structure include suspended deck system 10, suspended deck system 210, suspended deck system 410, variations of the suspended deck systems described herein, and any other suspended deck system considered suitable for a particular embodiment.

While the various embodiments of the suspended deck systems illustrated herein have been illustrated as being attached to a tower section that is a part of the tower of a wind turbine (e.g., wind turbine 12), a tower (e.g., wind turbine) that includes a suspended deck system, such as those described herein, can be provided as its own assembled structure, and/or as a kit. For example, an embodiment of a suspended deck system can include a tower that has one or more first tower sections and one or more second tower sections. Each of the one or more first tower sections includes a plurality of bosses, a plurality of links, a deck, and a plurality of fasteners, such as those described herein. Each of the one or more second tower sections is free of attachment to a deck and defines a substantially open tower chamber (e.g., free of a deck). For example, a tower can include a first tower section, a second tower section, and a third tower section. The first tower section can include a plurality of bosses, a plurality of links, a first deck, and a plurality of fasteners (e.g., the components included in suspended deck system 10). The second tower section can be attached to the first tower section (e.g., directly attached) and be free of attachment to the deck attached to the first tower section and include a substantially open tower chamber (e.g., free of a deck). The third tower section can be attached to the second tower section (e.g., directly attached) and include an attached second deck. The second deck can be attached to the third tower section using any suitable technique or method of attachment, such as the components described with respect to suspended deck system 10, or any other suspended deck system described herein.

Figure 14:
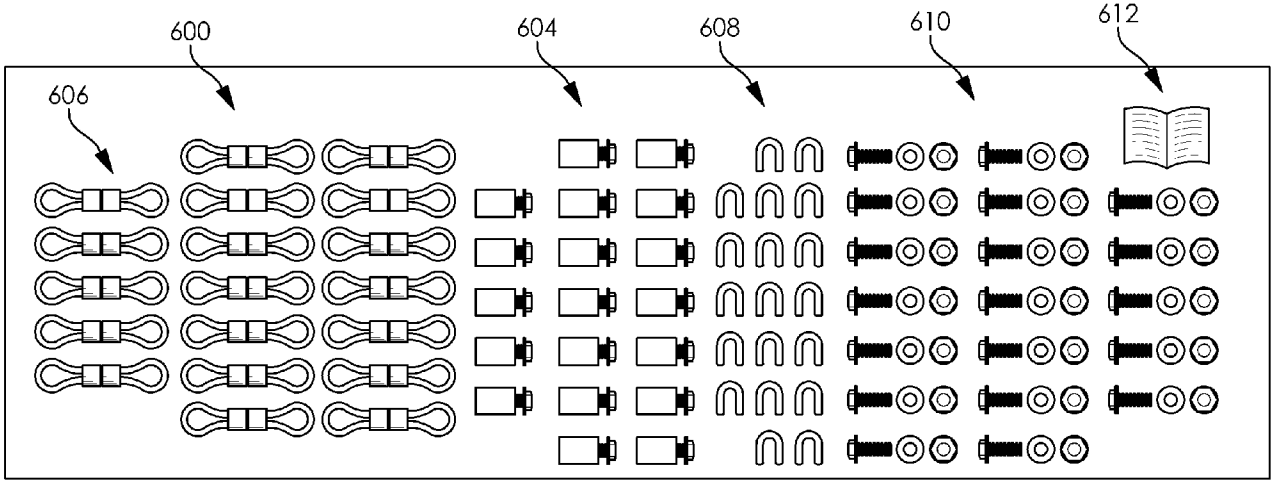
FIG. 14 is a top view of an example embodiment of a kit that includes the components for attaching a suspended deck system to a tower section.

FIG. 14 illustrates an example embodiment of a kit 600 that includes the components for attaching a suspended deck system to a component, such as a tower section of a wind turbine. The kit 600 includes a plurality of bosses 604 according to an embodiment, such as the plurality of bosses 46 illustrated in FIGS. 1, 2, 3, 4, 5, and 6; a plurality of links 606 according to an embodiment, such as the plurality of links 48 illustrated in FIGS. 1, 2, 3, 4, 5, and 6; a plurality of flanges 608 according to an embodiment, such as the plurality of flanges 506 illustrated in FIGS. 10, 11, and 12; a plurality of fasteners 610 according to an embodiment, such as the plurality of fasteners 52 illustrated in FIGS. 1, 2, 3, 4, 5, and 6; and instructions for use 612. Each boss of the plurality of bosses 604 is adapted to be attached to the tower section. Each link of the plurality of links 606 has a link first end that is adapted to be attached to a boss of the plurality of bosses 604 and a link second end that is adapted to be attached to a deck (e.g., a flange 608). Each flange of the plurality of flanges 608 is adapted to be attached to a deck. Each fastener of the plurality of fasteners 610 is adapted to be attached to a flange of the plurality of flanges 608. Alternative embodiments of a kit can include one or more towers, tower sections, and/or decks. In these alternative embodiments, if one or more towers are included in a kit, each tower can include one or more first tower sections and one or more second tower sections. Each of the one or more first tower sections has an attached suspended deck system, such as those described herein, or is adapted to be attached to a suspended deck system. Each of the one or more second tower sections is free of attachment to a suspended deck system and defines a substantially open tower chamber (e.g., free of a deck). In these alternative embodiments, if one or more decks are included in a kit, each deck is sized and configured to be movably attached to a component, such as a tower section of a wind turbine.

While kit 600 has been illustrated as including a plurality of bosses 604, a plurality of links 606, a plurality of flanges 608, and a plurality of fasteners 610 having a particular structural arrangement, a kit can include any suitable type and/or number of bosses, links, flanges, and fasteners. Selection of a suitable type and/or number of bosses, links, flanges, and fasteners to include in a kit according to an embodiment can be based on various considerations, such as the structural configuration of a tower section and/or the material(s) that forms a deck and/or tower section. Examples of bosses considered suitable to include in a kit include the plurality of bosses 46 illustrated with respect to FIGS. 1, 2, 3, 4, 5, and 6, the plurality of bosses 246 illustrated and described with respect to FIGS. 7, 8, and 9, the plurality of bosses 446 illustrated with respect to FIGS. 10, 11, and 12, variations of the bosses described herein, and any other boss considered suitable for a particular embodiment. Examples of links considered suitable to include in a kit include the plurality of links 48 illustrated with respect to FIGS. 1, 2, 3, 4, 5, and 6, the plurality of link 248 illustrated and described with respect to FIGS. 7, 8, and 9, the plurality of links 448 illustrated with respect to FIGS. 10, 11, and 12, variations of the links described herein, and any other link considered suitable for a particular embodiment. Examples of flanges considered suitable to include in a kit include the plurality of flanges 106 illustrated with respect to FIGS. 1, 2, 3, 4, 5, and 6, the plurality of flanges 306 illustrated and described with respect to FIGS. 7, 8, and 9, the plurality of flanges 506 illustrated with respect to FIGS. 10, 11, and 12, variations of the flanges described herein, and any other flange considered suitable for a particular embodiment. Examples of fasteners considered suitable to include in a kit include the plurality of fasteners 52 illustrated with respect to FIGS. 1, 2, 3, 4, 5, and 6, the plurality of fasteners 252 illustrated and described with respect to FIGS. 7, 8, and 9, variations of the fasteners described herein, and any other fastener considered suitable for a particular embodiment. Example numbers of bosses, links, flanges, and/or fasteners considered suitable to include in a kit that includes the components for attaching a suspended deck system to a component, such as a tower section of a wind turbine include one, at least one, two, a plurality, three, four, five, six, seven, eight, nine, ten, eleven, twelve, thirteen, fourteen, fifteen, sixteen, seventeen, eighteen, nineteen, twenty, more than twenty, and any other number considered suitable for a particular embodiment. Depending on the structural configuration of a boss of the plurality of bosses, a link of the plurality of links, and/or a flange of the plurality of flanges, alternative embodiments of a kit can omit the inclusion of a plurality of fasteners.

While kit 600 has been illustrated as including a plurality of flanges 608 that are separate components sized and configured to be attached to the deck of a suspended deck system, alternative embodiments of a kit can include one or more decks such that each includes a plurality of flanges. The plurality of flanges in these alternative embodiments can be separate components that are directly attached to a deck of the one or more decks or can be formed as integrated components of a deck of the plurality of decks.

Methods of installing a suspended deck system in a tower section and methods of inspecting and repairing a suspended deck system are described herein. While the methods described herein are shown an described as series of acts, it is to be understood and appreciated that the methods are not limited by the order of acts described and illustrated, as some acts may in accordance with these methods, be omitted, be repeated, or occur in different orders and/or concurrently with other acts described herein. While some steps, optional steps, and/or alternative steps are exemplified by installing a suspended deck system in a tower section or inspecting and repairing a suspended deck system in a tower section, the methods, steps, optional steps, and/or alternative steps described herein can be used to install, inspect, and/or repair a suspended deck systems in any suitable structure.

Figure 15:
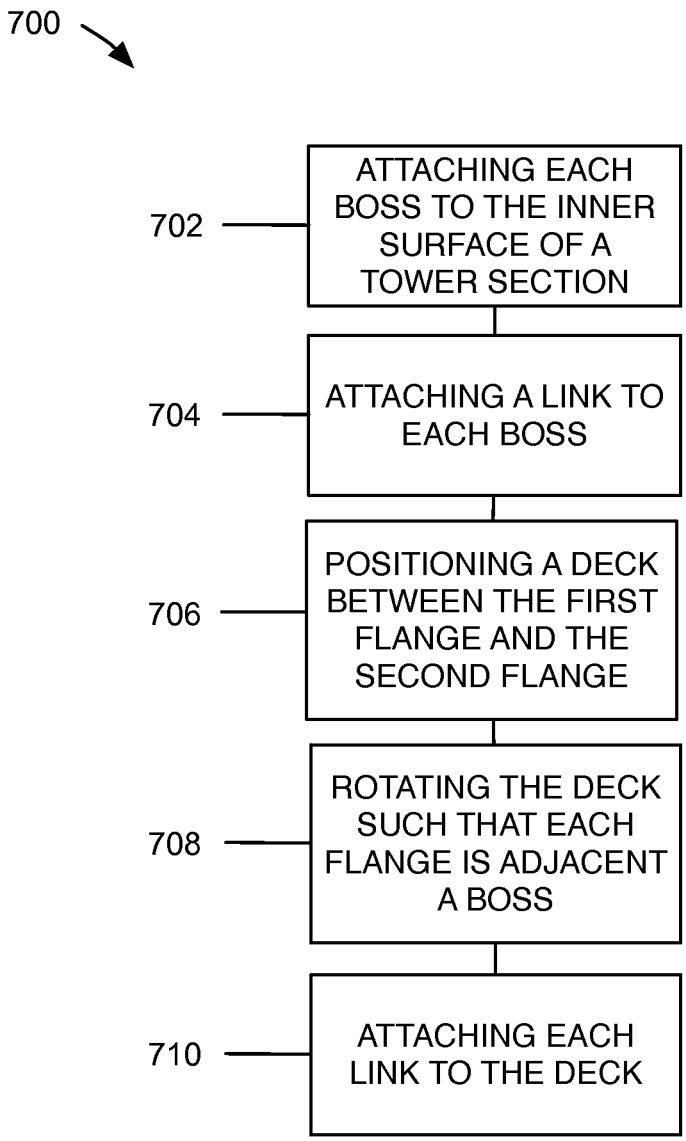
FIG. 15 is a schematic illustration of an example method of installing a suspended deck system in a tower section.

FIG. 15 is a schematic illustration of an example method 700 of installing a suspended deck system in a tower section. The tower section has a tower section lengthwise axis, a tower section first end, a tower section second end, and a tower section body that defines a tower section inner surface, a tower section outer surface, a tower section chamber, a tower section first flange at the tower section first end, and a tower section second flange at the tower section second end. A step 702 comprises attaching each boss of a plurality of bosses to the inner surface of a tower section. Each boss of the plurality of bosses is attached to the tower section between the tower section first flange and the tower section second flange. Another step 704 comprises attaching a link of a plurality of links to each boss of the plurality of bosses. Each link of the plurality of links has a link first end, a link second end, and a link length that extends from the link first end to the link second end. The link first end of each link of the plurality of links is attached to a boss of the plurality of bosses. Another step 706 comprises positioning a deck between the first flange and the second flange. The deck has a deck diameter and a plurality of flanges. The deck diameter is greater than the link length of each link of the plurality of links. Another step 708 comprises rotating the deck such that each flange of the plurality of flanges is positioned adjacent a boss of the plurality of bosses. Another step 710 comprises attaching the link second end of each link of the plurality of links to the deck (e.g., a flange of the plurality of flanges).

Step 702 can be accomplished in any suitable manner and using any suitable process and/or technique, such as welding each boss of a plurality of bosses to the inner surface of a tower section. Each boss of the plurality of bosses can be attached to a tower section in any suitable configuration. For example, each boss of the plurality of bosses can be disposed on a single plane that extends through, and is disposed orthogonal to, the lengthwise axis of the tower section or can be disposed on a plane that extends through, and is disposed at an angle to, the lengthwise axis of the tower section.

Step 702 can be accomplished using a boss that has any suitable configuration and selection of a suitable boss to attach to a tower section according to a particular embodiment can be based on various considerations, including the thickness of the body of a tower section. Examples of structural configurations considered suitable for a boss include those illustrated with respect to the plurality of bosses 46, the plurality of bosses 246, the plurality of bosses 446, variations of the bosses described herein, and any other boss considered suitable for a particular embodiment.

Optionally step 702 can be completed prior to, concurrent with, or subsequent to step 704, step 706, step 708, and/or step 710.

Step 704 can be accomplished in any suitable manner and using any suitable process and/or technique. For example, in embodiments in which a link is movably attached to a boss, step 704 can be accomplished by applying an axial force on the second member of each boss of the plurality of bosses that is directed through the first loop of a link of the plurality of links such that it is passed through the first loop of a link of the plurality of links. Another step comprises applying an axial force on the second member of each boss of the plurality of bosses that is directed toward a first member of a boss of the plurality of bosses such that the second end of the second member contacts the first member. Another step comprises releasably attaching the second member to the first member. This can be accomplished in any suitable manner and using any suitable process and/or technique, such as by applying a rotational force on the second member such that the second threaded portion of the second member mate with the threads of the first member. Alternatively, in embodiments in which a link is fixedly attached to a boss, step 704 can be accomplished by applying an axial force on a link of the plurality of links that is directed through an aperture defined by a boss of the plurality of bosses such that the link second end is passed through the aperture. Another step comprises continuing to apply the axial force on the link that is directed through the aperture until the stopper contacts the boss. Another step comprises fixedly attaching the link to the boss. This step can be accomplished using any suitable process and/or technique, such as by welding the stopper to the boss. Optionally, this step can be omitted in embodiments in which it is desired to releasably attach the link to a boss.

Step 704 can be accomplished using a link that has any suitable configuration and selection of a suitable link to attach to a boss according to a particular embodiment can be based on various considerations, including the structural configuration of the boss. Examples of structural configurations considered suitable for a link include those illustrated with respect to the plurality of links 48, the plurality of links 248, the plurality of links 448, variations of the links described herein, and any other link considered suitable for a particular embodiment.

Optionally step 704 can be completed prior to, concurrent with, or subsequent to step 702, step 706, step 708, and/or step 710.

An optional step comprises attaching a stopper to a link. This optional step can be accomplished using any suitable process and/or technique, such as welding the stopper to the link.

Step 706 can be accomplished in any suitable manner and using any suitable process and/or technique, such as by using a crane or other piece of equipment. For example, step 706 can be accomplished by applying a force on a deck that is directed into a tower section chamber. An optional step comprises directing the first surface of the deck toward the first flange of the tower section. This optional step can be accomplished using any suitable process and/or technique, such as by manipulating the deck until the first surface is directed toward the first flange of the tower section.

Step 706 can be accomplished while the tower section is positioned such that the tower section lengthwise axis is parallel, or substantially parallel, to the surface on which the tower section is positioned or while the tower section is positioned such that the tower section lengthwise axis is orthogonal, or substantially orthogonal, to the surface on which the tower section is positioned.

Step 706 and step 708, described below, can be accomplished using a deck that has any suitable configuration and selection of a suitable deck to attach to a tower section according to a particular embodiment can be based on various considerations, including the structural configuration of a link and/or boss. Examples of structural configurations considered suitable for a deck include the deck illustrated with respect to deck 50, deck 250, deck 450, variations of the decks described herein, and any other deck considered suitable for a particular embodiment.

Optionally step 706 can be completed prior to, concurrent with, or subsequent to step 702, step 704, step 708, and/or step 710. In embodiments in which step 706 is completed subsequent to step 702, step 706 can comprise positioning a deck between the plurality of bosses and the second flange.

Step 708 can be accomplished in any suitable manner and using any suitable process and/or technique, such as by using a crane or other piece of equipment. For example, step 708 can be accomplished by applying a rotational force on a deck that is directed around the tower section lengthwise axis. Step 708 can be accomplished while the tower section is positioned such that the tower section lengthwise axis is parallel, or substantially parallel, to the surface on which the tower section is positioned or while the tower section is positioned such that the tower section lengthwise axis is orthogonal, or substantially orthogonal, to the surface on which the tower section is positioned.

Optionally step 708 can be completed prior to, concurrent with, or subsequent to step 702, step 704, step 706, and/or step 710. In embodiments in which step 708 is completed prior to step 702, step 708 can comprise rotating the deck such that each flange of the plurality of flanges is positioned adjacent the desired attachment point of a boss of the plurality of bosses.

Step 710 can be accomplished in any suitable manner and using any suitable process and/or technique. For example, in embodiments in which the link second end is disposed between a fastener and a flange, step 710 can be accomplished by applying an axial force on the bolt of each fastener of the plurality of fasteners that is directed through a loop of a link of the plurality of links such that it is passed through the loop of the link of the plurality of links. Depending on the structural arrangement of the link, this step comprises passing a portion of a bolt through a second loop (e.g., link 48) or passing a portion of a bolt through a first loop (e.g., link 248). Another step comprises applying an axial force on bolt of each fastener of the plurality of fasteners that is directed toward an aperture defined by a flange of the plurality of flanges such that the bolt contacts the flange and the nut. Alternately, in embodiments in which one or more flanges define a plurality of apertures, this step comprises applying an axial force on bolt of each fastener of the plurality of fasteners that is directed toward an aperture defined by a flange of the one or more flanges such that the bolt contacts the flange and the nut.

Another step comprises releasably attaching the bolt to the flange. This can be accomplished in any suitable manner and using any suitable process and/or technique, such as by applying a rotational force on the bolt such that the second threaded portion of the bolt mates with the threads of the nut. Alternatively, in embodiments in which the flange defines threads within a passageway, this step can be accomplished by applying a rotational force on the bolt such that the second threaded portion of the bolt mates with the threads defined by the flange. An optional step that can be completed prior to attaching the bolt to the flange comprises passing the second end of a bolt through the passageway defined by a washer. This optional step can be accomplished using any suitable process and/or technique, such as by applying a force directed through the passageway of the washer until a portion of the bolt is disposed through the passageway of the washer.

In embodiments in which a fastener is omitted (e.g., FIGS. 10, 11, and 12), step 710 can be accomplished by applying a force on a first portion of a link such that the link second end is passed through the aperture defined by a flange. Another optional step comprises attaching the first portion of the link to a second portion of the link. This optional step can be accomplished using any suitable process and/or technique, such as by compressing a ferrule on the first portion and the second portion of the link.

Step 710 can be accomplished using a fastener that has any suitable configuration and selection of a suitable fastener to attach to a link to a deck can be based on various considerations, including the structural configuration of the flange. Examples of structural configurations considered suitable for a fastener include those illustrated with respect to the plurality of fasteners 52, the plurality of fasteners 252, variations of the fasteners described herein, and any other fastener considered suitable for a particular embodiment.

Optionally step 710 can be completed prior to, concurrent with, or subsequent to step 702, step 704, step 706, and/or step 708. Alternatively, step 710 can be completed prior to step 704, 706, and 708.

In embodiments in which a flange of the plurality of flanges, or the plurality of flanges, are separate components attached to the deck, an optional step that can be included in method 700 comprises attaching a flange, or each flange of the plurality of flanges, to the deck. This optional step can be accomplished using any suitable process and/or technique, such as by welding the flange, or each flange of the plurality of flanges, to the deck.

Another optional step comprises attaching the tower section to another tower section. This optional step can be accomplished using any suitable process and/or technique, such as by using a crane and positioning the tower section on a second tower section. Another optional step comprises aligning the tower section second flange with the tower section first flange of the second tower section.

While method 700 has been described with respect to installing a suspended deck system in a tower section, the steps, optional steps, and/or alternative steps described herein can be accomplished to attach a suspended deck system to any suitable structure. Selection of a suitable structure to attach a suspended deck system according to a particular embodiment can be based on various considerations, including the intended use of the suspended deck system. Example structures considered suitable to attach a suspended deck system according to an embodiment include tubular members, tower sections, towers, structures that form an enclosed chamber and/or shaft, structures that form a partially enclosed chamber and/or shaft, and any other structure considered suitable for a particular embodiment.

Method 700 can be completed prior to, during, or subsequent to the tower section being installed as part of a wind turbine tower. For example, in embodiments in which method 700 is completed prior to the tower section being installed as part of a wind turbine tower, any of the steps, optional steps, and alternative steps described herein can be accomplished while the tower section is positioned on its side (e.g., tower section lengthwise axis is parallel, or substantially parallel, to the surface on which the tower section is positioned) or while the tower section is positioned such that the tower section lengthwise axis is orthogonal, or substantially orthogonal, to the surface on which the tower section is positioned.

Figure 16:
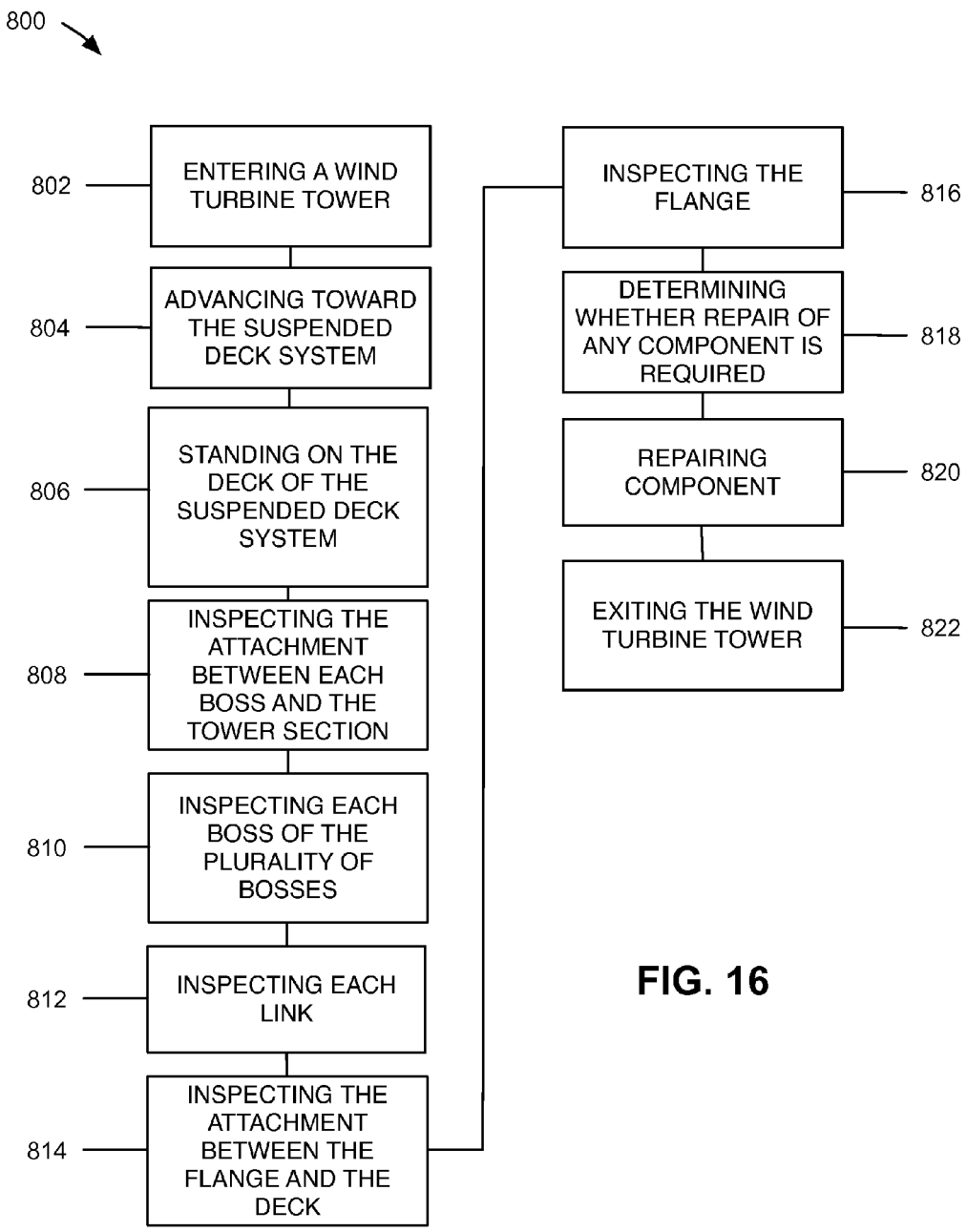
FIG. 16 is a schematic illustration of an example method of inspecting and repairing a suspended deck system attached to a tower section.

FIG. 16 is a schematic illustration of an example method 800 of inspecting and repairing a suspended deck system attached to a tower section. A step 802 comprises entering a wind turbine tower that comprises a plurality of tower sections and at least one suspended deck system attached to a tower section. Each tower section has a tower section lengthwise axis, a tower section first end, a tower section second end, and a tower section body that defines an inner surface, an outer surface, a tower section chamber, a tower section first flange at the tower section first end, and a tower section second flange at the tower section second end. The at least one suspended deck system comprises a plurality of bosses, a plurality of links, and at least one flange attached to a deck. Another step 804 comprises advancing toward the suspended deck system intended to be inspected and/or repaired. The suspended deck system intended to be inspected/repaired is attached to the tower section between the tower section first flange and the tower section second flange. Another step 806 comprises standing on the deck of the suspended deck system intended to be inspected and/or repaired. Another step 808 comprises inspecting the attachment between each boss of the plurality of bosses and the tower section body. Each boss of the plurality of bosses is disposed between the tower section first flange and the deck. Another step 810 comprises inspecting each boss of the plurality of bosses. Another step 812 comprises inspecting each link of the plurality of links. Each link of the plurality of links is disposed between the tower section first flange and the deck. Another step 814 comprises inspecting the attachment between the flange and the deck. The attachment between the flange and the deck is disposed between the deck and the tower section first flange. Another step 816 comprises inspecting the flange. Another step 818 comprises determining whether repair of a component is required. Another step 820 comprises repairing the component. Another step 822 comprises exiting the wind turbine tower.

Step 802 can be accomplished using any suitable process and/or technique, such as by opening a door to the tower that provides access to the tower section chamber and stepping into the tower section chamber.

Step 804 can be accomplished using any suitable process and/or technique, such as by using a ladder and/or an elevator.

Step 806 can be accomplished using any suitable process and/or technique, such as by stepping off of a ladder and onto the suspended deck system intended to be inspected and/or repaired or by stepping off of an elevator and onto the suspended deck system intended to be inspected and/or repaired.

Step 808 can be accomplished using any suitable process and/or technique and will depend on the type of attachment between a boss and the tower section body. For example, step 808 can be accomplished by performing a visual weld inspection, a radiographic weld inspection, a magnetic particle inspection, liquid penetrant inspection, ultrasonic inspection, and any other process and/or technique considered suitable for a particular embodiment.

Step 810 can be accomplished using any suitable process and/or technique and will depend on the type of boss used in the suspended deck system. For example, step 810 can be accomplished by performing a visual inspection of each boss of the plurality of bosses.

Step 812 can be accomplished using any suitable process and/or technique and will depend on the type of link used in the suspended deck system. For example, step 812 can be accomplished by performing a visual inspection of each link of the plurality of links.

Step 814 can be accomplished using any suitable process and/or technique and will depend on the type of attachment between a flange and the body of a deck. For example, step 814 can be accomplished by performing a visual weld inspection, a radiographic weld inspection, a magnetic particle inspection, liquid penetrant inspection, ultrasonic inspection, and any other process and/or technique considered suitable for a particular embodiment.

While step 814 comprises inspecting the attachment between the flange and the deck, alternative embodiments can include a plurality of flanges. In these alternative embodiments, step 814 comprises inspecting the attachment between each flange of the plurality of flanges and the deck. This alternative step can be accomplished using any suitable process and/or technique, and will depend on the type of attachment between a flange and the body of a deck. For example, this alternative step can be accomplished by performing a visual weld inspection, a radiographic weld inspection, a magnetic particle inspection, liquid penetrant inspection, ultrasonic inspection, and any other process and/or technique considered suitable for a particular embodiment. In embodiments in which the flange, or each flange in a plurality of flanges, is formed as an integrated component of a deck, step 814 can be omitted from method 800.

Step 816 can be accomplished using any suitable process and/or technique and will depend on the type of flange used in the suspended deck system. For example, step 816 can be accomplished by performing a visual inspection of the flange.

While step 816 comprises inspecting the flange, alternative embodiments can include a plurality of flanges. In these alternative embodiments, step 816 comprises inspecting the each flange of the plurality of flanges. This alternative step can be accomplished using any suitable process and/or technique, and will depend on the type of flange used in the suspended deck system. For example, this alternative step can be accomplished by performing a visual inspection of the flange.

Step 818 is based upon the results of step 808, step 810, step 812, step 814, and/or step 816. For example, if step 808, step 810, step 812, step 814, and/or step 816 indicate that the component or feature being inspected is defective, faulty, and/or ineffective for its intended purpose, then repair of the component or feature will be necessary. Alternatively, if step 808, step 810, step 812, step 814, and/or step 816 indicate that the component or feature being inspected is functioning properly and/or is effective for its intended purpose, then repair of the component or feature is not necessary.

If step 818 results in a determination that repair of a component or feature is necessary, step 820 can be accomplished using any suitable process and/or technique and will depend on the type of component or feature being repaired and the type of repair being made. For example, if the attachment between a boss and the tower section or a boss of the plurality of bosses is determined to be defective, faulty, and/or ineffective for its intended purpose, step 820 comprises removing the boss of the plurality of bosses from the body of the tower section, repairing the attachment between the boss and the tower section body, and/or repairing the boss. Another optional step comprises attaching another boss to the body of the tower section. This optional step can be accomplished as described with respect to step 702 described above. Alternatively, if the attachment between a link and a boss, the attachment between a link and a flange, or a link of the plurality of links is determined to be defective, faulty, and/or ineffective for its intended purpose, step 820 comprises removing the link of the plurality of links or repairing the attachment between the link and the boss, repairing the attachment between the link and the flange, and/or repairing the link. Another optional step comprises attaching another link to the boss and the flange.

This optional step can be accomplished as described with respect to step 704 and/or step 710 described above. Alternatively, if the attachment between a flange and the deck or a flange is determined to be defective, faulty, and/or ineffective for its intended purpose, step 820 comprises removing the flange from the body of the deck, repairing the attachment between the flange and the deck, and/or repairing the flange. Another optional step comprises attaching another flange to the body of the deck. This optional step can be accomplished as described with respect to the optional step of attaching a flange to a deck described above with respect to method 600. Depending on the number of components that require repair, as determined in step 818, step 820 can optionally be repeated.

In embodiments in which a fastener, or a plurality of fasteners, has been used to attach a link to a flange, an optional step comprises inspecting each fastener. This optional step can be accomplished using any suitable process and/or technique and will depend on the type of fastener used in the suspended deck system. For example, this optional step can be accomplished by performing a visual inspection of each fastener. Another optional step comprises determining whether repair is required. This optional step is based upon the results of the optional step of inspecting each fastener. For example, if the optional step of inspecting each fastener indicates that the fastener being inspected is defective, faulty, and/or ineffective for its intended purpose, then repair of the fastener will be necessary. Alternatively, if the optional step of inspecting each fastener indicates that the fastener being inspected is functioning properly and/or is effective for its intended purpose, then repair of the fastener is not necessary. Another optional step comprises repairing the fastener if it is determined that the fastener is defective, faulty, and/or ineffective. This optional step can be accomplished using any suitable process and/or technique and will depend on the type of component being repaired and the type of repair being made. An optional step comprises removing the fastener. This optional step can be accomplished by applying a rotational force on the bolt such that the second threaded portion of the bolt becomes free of the nut or threads defined by the flange and by applying an axial force on the bolt until it is free of the loop defined by the link. Another optional step comprises attaching another fastener to the link and the flange. This optional step can be accomplished as described with respect to step 710 described above.

Step 822 can be accomplished using any suitable process and/or technique, such as by stepping out of the tower section chamber and closing the door to the tower section that provides access to the tower section chamber.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A suspended deck system comprising:

a tower section having a tower section lengthwise axis, a tower section first end, a tower section second end, and a tower section body that defines a tower section first flange at the tower section first end, and a tower section second flange at the tower section second end;

a plurality of bosses attached to the tower section body between the tower section first flange and the tower section second flange;

a plurality of links, each link of the plurality of links having a link first end, a link second end, and a link length extending from the link first end to the link second end, the link first end of each link of the plurality of links attached to a boss of the plurality of bosses; and a deck having a top surface, a bottom surface, and a deck body that has a deck diameter, the top surface disposed between the bottom surface and the plurality of bosses, the deck diameter greater than the link length of each link of the plurality of links, the deck attached to the link second end of each link of the plurality of links between the plurality of bosses and the top surface.

2. The suspended deck system of claim 1, wherein each boss of the plurality of bosses is disposed on a plane that passes through the tower section lengthwise axis.

3. The suspended deck system of claim 2, wherein the plane is disposed orthogonal to the tower section lengthwise axis.

4. The suspended deck system of claim 1, wherein the link first end of each link of the plurality of links is moveably attached to a boss of the plurality of bosses.

5. The suspended deck system of claim 1, wherein the deck is movably attached to the link second end of each link of the plurality of links.

6. The suspended deck system of claim 1, further comprising a plurality of flanges attached to the deck body; and wherein the link second end of each link of the plurality of links is attached to a flange of the plurality of flanges.

7. The suspended deck system of claim 6, further comprising a plurality of attachment members, each attachment member of the plurality of attachment members releasably attached to a flange of the plurality of flanges; and wherein the link second end of each link of the plurality of links is disposed between an attachment member of the plurality of attachment members and a flange of the plurality of flanges.

8. The suspended deck system of claim 6, wherein each flange of the plurality of flanges is a separate member attached to the deck body.

9. The suspended deck system of claim 1, further comprising a flange attached to the deck body; and wherein the link second end of each link of the plurality of links is attached to the flange.

10. The suspended deck system of claim 9, wherein the flange defines a plurality of apertures; and wherein a portion of each link of the plurality of links is disposed through an aperture of the plurality of apertures defined by the flange.

11. The suspended deck system of claim 9, wherein the flange is a separate member attached to the deck.

12. The suspended deck system of claim 1, wherein each boss of the plurality of bosses comprises a first member and a second member releasably attached to the first member; and wherein the link first end of each link of the plurality of links is disposed between the first member and the second member of a boss of the plurality of bosses.

13. The suspended deck system of claim 1, wherein each link of the plurality of links has a link body that defines a first loop and a second loop; and wherein a portion of each boss of the plurality of bosses is partially disposed through the first loop of a link of the plurality of links.

14. The suspended deck system of claim 1, wherein each link of the plurality of links comprises a flexible cable.

15. A suspended deck system comprising:

a tower section having a tower section lengthwise axis, a tower section first end, a tower section second end, and a tower section body that defines a tower section first flange at the tower section first end, and a tower section second flange at the tower section second end;

a plurality of bosses attached to the tower section body between the tower section first flange and the tower section second flange, each boss of the plurality of bosses disposed on a plane that passes through the tower section lengthwise axis;

a plurality of links, each link of the plurality of links having a link first end, a link second end, and a link length extending from the link first end to the link second end, the link first end of each link of the plurality of links movably attached to a boss of the plurality of bosses; and a deck having a top surface, a bottom surface, a deck body, and a plurality of flanges attached to the deck body, the deck body having a deck diameter that is greater than the link length of each link of the plurality of links, the top surface disposed between the bottom surface and the plurality of bosses, each flange of the plurality of flanges movably attached to the link second end of a link of the plurality of links between the plurality of bosses and the top surface.

16. The suspended deck system of claim 15, wherein the plane is disposed orthogonal to the tower section lengthwise axis.

17. The suspended deck system of claim 15, further comprising a plurality of attachment members, each attachment member of the plurality of attachment members releasably attached to a flange of the plurality of flanges; and wherein the link second end of each link of the plurality of links is disposed between an attachment member of the plurality of attachment members and a flange of the plurality of flanges.

18. The suspended deck system of claim 15, wherein each flange of the plurality of flanges is a separate member attached to the deck body.

19. The suspended deck system of claim 15, wherein each link of the plurality of links has a link body that defines a first loop and a second loop; and wherein a portion of each boss of the plurality of bosses is partially disposed through the first loop of a link of the plurality of links.

20. A tower comprising:

a first tower section having a first tower section lengthwise axis, a first tower section first end, a first tower section second end, and a first tower section body that defines a first tower section first flange at the first tower section first end, and a first tower section second flange at the first tower section second end;

a plurality of bosses attached to the first tower section body between the first tower section first flange and the first tower section second flange;

a plurality of links, each link of the plurality of links having a link first end, a link second end, and a link length extending from the link first end to the link second end, the link first end of each link of the plurality of links attached to a boss of the plurality of bosses;

a first deck having a top surface, a bottom surface, and a first deck body that has a first deck diameter, the top surface disposed between the bottom surface and the plurality of bosses, the first deck diameter greater than the link length of each link of the plurality of links, the first deck attached to the link second end of each link of the plurality of links between the plurality of bosses and the top surface;

a second tower section attached to the first tower section and being free of attachment to the deck;

a third tower section attached to the second tower section; and a second deck attached to the third tower section;

wherein the second tower section is disposed between the first tower section and the third tower section.

* * * * *